US010036125B2

(12) United States Patent
MacPherson et al.

(10) Patent No.: US 10,036,125 B2
(45) Date of Patent: Jul. 31, 2018

(54) SECURITY DEVICE

(71) Applicant: Nanotech Security Corp., Thurso (CA)

(72) Inventors: Charles Douglas MacPherson, Santa Barbara, CA (US); Denis Gerard Vendette, Embrun (CA)

(73) Assignee: Nanotech Security Corp., Thurso (CA)

( * ) Notice: Subject to any disclaimer, the term of this patent is extended or adjusted under 35 U.S.C. 154(b) by 247 days.

(21) Appl. No.: 14/708,726

(22) Filed: May 11, 2015

(65) Prior Publication Data

US 2016/0333526 A1 Nov. 17, 2016

(51) Int. Cl.

| | |
|---|---|
| ***B42D 25/387*** | (2014.01) |
| ***D21H 21/48*** | (2006.01) |
| ***B42D 25/36*** | (2014.01) |
| ***B42D 25/324*** | (2014.01) |
| ***B42D 25/351*** | (2014.01) |
| ***B42D 25/328*** | (2014.01) |

(52) U.S. Cl.

CPC ..... *D21H 21/48* (2013.01); *B42D 25/324* (2014.10); *B42D 25/328* (2014.10); *B42D 25/351* (2014.10); *B42D 25/36* (2014.10); *B42D 25/387* (2014.10)

(58) Field of Classification Search

CPC ..... B42D 25/387
USPC ..... 283/92
See application file for complete search history.

(56) References Cited

U.S. PATENT DOCUMENTS

| | | | |
|---|---|---|---|
| 4,451,521 | A | 5/1984 | Kaule et al. |
| 5,388,862 | A | 2/1995 | Edwards et al. |
| 6,036,232 | A | 3/2000 | Kaule et al. |
| 6,040,937 | A | 3/2000 | Miles |
| 6,055,090 | A | 4/2000 | Miles |

(Continued)

FOREIGN PATENT DOCUMENTS

| | | | |
|---|---|---|---|
| CA | 2149550 | C | 5/2006 |
| CA | 2471357 | C | 2/2011 |

(Continued)

OTHER PUBLICATIONS

"Reflectivity of Iridescent Coextruded Multilayered Plastic Films", J.A. Radford, et al., Polymer Engineering and Science, May 1973, vol. 13, No. 3.

(Continued)

*Primary Examiner* — Kyle R Grabowski

(57) ABSTRACT

A security device with multiple layers. A substrate provides the backing to a first luminescent layer. An optically variable structure is positioned between the first luminescent layer and a second luminescent layer. Both the first and second luminescent layers emit luminescent radiation when stimulated. When the first layer is stimulated, the optically variable structure filters the emitted luminescent radiation such that the emitted luminescent radiation only escapes the optically variable structure at a predetermined range of emission angles. A user, when viewing the security device from the predetermined range of angles as both layers are stimulated, can see a completed image of a predetermined indicia. When the security device is viewed at angles other than the predetermined range of angles as both layers are stimulated, a user will only see an incomplete image of the predetermined indicia.

10 Claims, 13 Drawing Sheets

(56) References Cited

U.S. PATENT DOCUMENTS

| | | | | |
|---|---|---|---|---|
| 6,089,614 | A * | 7/2000 | Howland | B42D 25/342 283/94 |
| 6,165,592 | A | 12/2000 | Kato et al. | |
| 6,210,777 | B1 | 4/2001 | Vermeulen et al. | |
| 6,505,480 | B2 | 1/2003 | Tsuboe et al. | |
| 6,534,158 | B2 * | 3/2003 | Huang | B42D 25/29 359/1 |
| 6,565,770 | B1 | 5/2003 | Mayer et al. | |
| 6,572,784 | B1 | 6/2003 | Coombs et al. | |
| 6,650,455 | B2 | 11/2003 | Miles | |
| 6,666,991 | B1 | 12/2003 | Atarashi et al. | |
| 6,695,905 | B2 | 2/2004 | Rozumek et al. | |
| 7,040,663 | B1 | 5/2006 | Plaschka et al. | |
| 7,654,581 | B2 * | 2/2010 | Cruikshank | B42D 25/387 283/94 |
| 8,367,277 | B2 | 2/2013 | Brehm et al. | |
| 8,383,014 | B2 | 2/2013 | Vanheusden et al. | |
| 8,523,238 | B2 * | 9/2013 | Sekine | B42D 25/387 283/92 |
| 2002/0018430 | A1 | 2/2002 | Heckenkamp et al. | |
| 2003/0056688 | A1 | 3/2003 | Muller et al. | |
| 2003/0188842 | A1 | 10/2003 | Ronnenberg | |
| 2005/0104364 | A1 | 5/2005 | Keller et al. | |
| 2005/0240549 | A1 | 10/2005 | Adamczyk et al. | |
| 2007/0080533 | A1 | 4/2007 | Bleikholm et al. | |
| 2007/0183047 | A1 | 8/2007 | Phillips et al. | |
| 2007/0211238 | A1 | 9/2007 | Hoffmuller et al. | |
| 2007/0211317 | A1 | 9/2007 | Heim | |
| 2007/0241553 | A1 | 10/2007 | Heim | |
| 2007/0273144 | A1 | 11/2007 | Phillips et al. | |
| 2007/0275189 | A1 | 11/2007 | Phillips et al. | |
| 2007/0281177 | A1 | 12/2007 | Haubrich et al. | |
| 2008/0019003 | A1 | 1/2008 | Phillips et al. | |
| 2009/0315316 | A1 | 12/2009 | Staub et al. | |
| 2009/0317595 | A1 | 12/2009 | Brehm et al. | |
| 2010/0230615 | A1 * | 9/2010 | MacPherson | B42D 25/364 359/290 |
| 2012/0068450 | A1 | 3/2012 | Machpherson et al. | |
| 2012/0321783 | A1 | 12/2012 | Hampden-Smith et al. | |

FOREIGN PATENT DOCUMENTS

| | | | | |
|---|---|---|---|---|
| CA | 2589970 | C | 2/2013 | |
| CA | 2609631 | C | 10/2013 | |
| CA | 2544586 | C | 1/2014 | |
| EP | 0680411 | A1 | 12/1994 | |
| EP | 1669213 | A1 | 6/2006 | |
| EP | 1719636 | A1 | 11/2006 | |
| EP | 2028017 | A2 * | 2/2009 | B42D 25/387 |
| WO | 9966513 | A1 | 12/1999 | |
| WO | 2008043981 | A1 | 4/2008 | |

OTHER PUBLICATIONS

"Physical Optics or Iridecent Multilayered Plastic Films", T. Alfrey, Jr., et al., Polymer Engineering and Science, Nov. 1969, vol. 9, No. 6.

Electronic Imaging Science and Technology, Jan. 15-19, 2006, San Jose, California, USA, "Optical Security and Counterfeit Deterrence Techniques VI", http://electronicimaging.ord/program/06/conferences/index.cfm?fuseaction=6075.

"Optical Thin-Film Security Devices", J.A. Dobrowolski, Optical Document Security, Chapter 13, pp. 289-328.

International Search Report from PCT/CA2010/000248.

* cited by examiner

SECURITY DEVICE

TECHNICAL FIELD

The present invention relates to security devices and in particular to optical security devices for authenticating bank notes, financial transaction cards, documents of value or identity, branded goods and other items for protection against counterfeiting.

BACKGROUND OF THE INVENTION

Overt security elements including watermarks, metallic threads and optically variable devices such as holographic foils have been used for some time to authenticate documents, bank notes and other financial transaction instruments, such as credit and debit cards, for protection against copying and counterfeiting. Such security elements are classified as Level 1 in that their presence is visible to the naked eye. Level 2 security features, such as those which have luminescent properties are also used for authentication. In this case, the security feature is normally hidden under ambient light and is only revealed to the naked eye when illuminated by a special light source such as a UV lamp. Level 3 security features may also include features which can only be detected by a machine, such as those which emit outside the visible spectrum or are based on magnetic or electrical properties of a material.

Security features may be classified as "human unassisted" or Level 1, in which the security feature is visible to the naked eye and can be authenticated by a human without machine assistance, "human assisted" or Level 2 which is defined as one in which the authentication process is performed by a person with the assistance of a tool or device, and "machine readable" in which the security feature is both detected and its authentication processed by a machine.

One of the most common Level 2 human assisted features found on bank notes is the ultra-violet (UV) fluorescent feature. This feature is typically applied as an ink, which may be visible or invisible, by offset printing and usually forms an image made up of one to three colours (red, green, blue). The image is detected by exposure of the bank note to a UV light source (typically UVA at 365 nm). This feature has provided a reasonably good level of security against most primitive and hobbyist type counterfeiting in the past.

The current fluorescent feature found on many currencies typically consists of a fluorescent pigment added to an offset ink either in a coloured or colourless ink base. A fluorescent image is revealed when the bank note is inspected with a UVA lamp (365 nm). Although this feature has proven to be an effective level 2 security feature (authentication requiring a mechanical or special equipment aid), it is under increasing threat in recent times. There is therefore a need for an improved UV fluorescent security feature that can operate with the current installed base of UV lamps found in the retail setting.

Accordingly, there is a need for an alternative security feature which is more robust against copying and counterfeiting.

SUMMARY OF INVENTION

The present invention provides a security device with multiple layers. A substrate provides the backing to a first luminescent layer. An optically variable structure is positioned between the first luminescent layer and a second luminescent layer. Both the first and second luminescent layers emit luminescent radiation when stimulated. When the first layer is stimulated, the optically variable structure filters the emitted luminescent radiation such that the emitted luminescent radiation is only transmitted through the optically variable structure at a predetermined range of emission angles. When the security device is viewed at angles other than the predetermined range of angles as both layers are stimulated, a user will only observe emission that is not transmitted through the optical variable structure and therefore only an incomplete image of the predetermined indicia will be visible to the user. A user, when viewing the security device from the predetermined range of angles while both layers are stimulated, can see emission from the luminescent layer on both sides of the optical variable structure and thus the user can observe a completed image of a predetermined indicia.

In a first aspect, the present invention provides a security device comprising:

- a first luminescent layer which, when stimulated, emits luminescent radiation of at least a first wavelength;
- a second luminescent layer which, when stimulated, emits luminescent radiation of at least a second wavelength;
- an optically variable structure for controlling said luminescent radiation of said first luminescent layer, said structure being constructed and arranged to permit emission of luminescent radiation of said first wavelength through said structure at a first range of angles, said structure being constructed and arranged to minimize emission of luminescent radiation from said first luminescent layer for a second range of angles;

wherein

- said optically variable structure is positioned between said first luminescent layer and said second luminescent layer;
- said first luminescent layer is positioned such that said emission of luminescent radiation through said structure at said first range of angles is visible to a user;
- said second luminescent layer is positioned to allow said user to view emission of luminescent radiation of said second wavelength from said second luminescent layer;
- said first luminescent layer, when producing luminescent radiation of said first wavelength, forms a first image;
- said second luminescent layer, when producing luminescent radiation of said second wavelength, forms a second image;
- said first image complements said second image such that when said first and second image are viewed together, said first and second image form a third image.

In a second aspect, the present invention provides a security device comprising:

- a first luminescent layer which, when stimulated, emits luminescent radiation of at least a first wavelength;
- a second luminescent layer which, when stimulated, emits luminescent radiation of at least a second wavelength;
- a structure for controlling said luminescent radiation from at least one of said first luminescent layer and said second luminescent layer, said structure being constructed and arranged to permit emission of luminescent radiation of said first wavelength through said structure at a first range of angles, said structure being constructed and arranged to minimize emission of luminescent radiation from said first luminescent layer for a second range of angles;

wherein said first luminescent layer is positioned such that said emission of luminescent radiation through said structure at said first range of angles is visible to a user;

said second luminescent layer is positioned to allow said user to view emission of luminescent radiation of said second wavelength from said second luminescent layer;

said first luminescent layer, when producing luminescent radiation of said first wavelength, forms a first image;

said second luminescent layer, when producing luminescent radiation of said second wavelength, forms a second image;

said first image and said second image, when combined, forms a third image.

In one embodiment, the arrangement of the present invention provides a luminescent security feature in which the spectral content or colour of the luminescence emitted from the first luminescent layer of the security device varies with the angle of emission due to the optically variable structure. When viewed at the predetermined range of emission angles, the luminescent radiation from the first luminescent layer allowed to pass through by the optically variable structure completes the image of the predetermined indicia when combined with the luminescent image from the second layer on top of the optically variable structure. This provides a further detectable characteristic which can be used to authenticate the security feature and significantly improves the robustness of luminescent security features against copying and counterfeiting.

Specifically, the optically variable structure filters the luminescent radiation emitted by the first layer of the security device such that, at the predetermined emission angles, the luminescent radiation allowed to pass through matches with or is similar to the luminescent radiation emitted by the second layer.

In another embodiment, the optically variable structure controls the visibility to a user of radiation emitted by the first luminescent layer when that layer is stimulated. At select ranges of emission angles, radiation emitted by the first luminescent layer is visible to a user. When viewed at angles other than the select ranges of emission angles, radiation emitted by the first luminescent layer is not visible to the user. Radiation emitted by the second layer, on the other hand, is preferably always visible to a user when the second layer is stimulated. When only radiation from the second luminescent layer is visible to a user, an incomplete image of the predetermined indicia is visible to the user. When radiation from both the first and second luminescent layers are visible to a user, they form a complete image of a predetermined indicia. The first luminescent layer is on the side of an optical thin film which is opposite to the observer side while the second luminescent layer is on the same side of the optical thin film as the observer side. Typically, the security feature operates in the manner where, on normal viewing of the banknote or document, the second luminescent layer is visible to observer. The first luminescent layer located opposite observer side on the optical thin film is not visible because the optical thin film is not transparent to this first luminescent layer's radiation at the normal angle of incidence. The image of the predetermined indicia at normal view is incomplete. Upon tilting the document or banknote, the luminescent emission from the first luminescent layer located behind or beneath or opposite the viewer side of the optical thin film layer become visible due to the angular dependant optical properties of the optical thin film. At an angle of approximately 45 degrees with respect to a normal view, the optical film becomes significantly more transparent to the luminescent emission of the first luminescent layer. The observer with the banknote tilted at a 45 degree angle can now observe both the luminescent emissions from the first and second luminescent layers and if the two printed luminescent layers are registered with respect to one another on opposite sides of the optical thin film, this produces a complete and easily recognizable indicia. The resulting image will now become clear to the observer holding the note under a UV stimulating light source.

In some embodiments, the optically variable structure controls visibility of luminescent radiation from the first luminescent layer minimizes the luminescent radiation emission at an angle or at a range of angles other than predetermined emission angles or a predetermined range or ranges of emission angles.

It should be noted that the term "colour" is used herein in the broad sense of the word to mean the result produced by either a single wavelength component in the electromagnetic spectrum or a combination of different wavelength components in the electromagnetic spectrum, each component having a particular intensity relative to the other component (s). The term "colour" applies to both the visible part of the electromagnetic spectrum and to parts outside the visible spectrum including infrared (IR) and ultraviolet (UV).

As used herein, the term "luminescent material" refers any material that converts at least part of incident energy into emitted radiation with a characteristic signature. For example, the luminescent material may convert incident radiation of one wavelength into emitted radiation of a different wavelength. Non-limiting examples include materials which exhibit fluorescence and/or phosphorescence.

It should also be noted that, when both the first and second luminescent layers are stimulated, wavelengths of at least some of the luminescence emissions from these first and second luminescent layers are in the visible spectrum. Advantageously, this enables the security feature to be detected and authenticated by a person. When the luminescent emissions from both the first and second luminescent layers are in the visible spectrum, when viewed at the predetermined emission angle or at the predetermined range of emission angles, a complete image of the predetermined indicia appears to a human authenticator. When viewed at angles or at ranges or angles other than the emission angle or other than the predetermined range of emission angles, an incomplete image of the predetermined indicia will appear to the human authenticator. It should be noted that, when appearing as a complete image, the predetermined indicia may appear in a single color or it may appear in a multitude of colors. If appearing in more than one color, the different colours may be selected so that they are easily distinguishable from one another to a user's naked eye. In one, non-limiting variant, the different colours may be selected from red, green and blue.

In some embodiments, one or both luminescent layers may emit luminescent radiation of the same or different wavelengths. These layers may comprise luminescent material selected so as to only generate luminescence at one or both of first and second wavelengths in response to electromagnetic radiation outside the visible spectrum, so that the luminescence requires a special source of stimulating radiation and is inactive or relatively inactive under ambient conditions. If the first and second wavelengths are in the visible spectrum, this allows the luminescent colours to be concealed under ambient light. In some embodiments, the luminescent material is responsive to ultraviolet (UV) light to generate luminescence of one or both of the first and second wavelengths. This may enable the luminescence security feature to be stimulated by the same UV light sources which are currently used to stimulate conventional luminescent security features, and which are in common usage in many locations, such as banks and retail outlets, thereby avoiding the need and expense for replacing existing equipment. In some embodiments, the luminescent material may be selected so that both the first and second wavelengths are stimulated by the same UV light source, i.e. the same UV wavelength. As many existing UV light sources for authentication emit a single UV wavelength, this arrangement may also prevent the need to replace or modify existing equipment.

In other embodiments, for one or both emission wavelengths, the luminescent material may respond to UV radiation to generate luminescence in the infrared spectrum or may be responsive to visible light to generate luminescence in the infrared spectrum. In other embodiments, for one or both luminescence wavelengths, the luminescent material may respond to stimulating radiation of a longer wavelength to generate luminescence of a shorter wavelength (anti-Stokes), for example, to generate luminescence radiation in the visible spectrum in response to an infrared source. In other embodiments, for one or both luminescent wavelengths, the luminescent material may respond to radiation in the visible spectrum to generate luminescence in the visible spectrum and thus may comprise a "Day glow" phosphorescent material. In this case, the luminescent emission may be observed under relative dark conditions.

In some embodiments, the luminescent radiation from the security device, once the layers have been activated, is in the visible spectrum and will thus appear as a distinct visible colour at a particular viewing angle, thereby enabling the feature to be authenticated by a human. In some embodiments, the emission wavelengths from the security device, including those permitted to pass through by the optically variable structure, may be in the visible spectrum and appear as different visible colours at different viewing angles. Of course, once properly activated, the layers emit luminescent radiation at wavelengths which, when viewed by a user at the predetermined emission angle or predetermined range of emission angles, provides a complete image of the predetermined indicia.

Other embodiments may include a luminescent material which luminesces at multiple different wavelengths, to provide different optical or luminescent characteristics. The optically variable structure may control the angle of observation of each additional component of the luminescence spectra so that each additional component is only observable at a particular viewing angle or at a particular range of viewing angles.

In some embodiments, the optically variable structure is at least partially transparent or transmissive to stimulating radiation for stimulating the luminescent material. The optically variable structure minimizes emission of luminescent radiation from the first luminescent layer by reflecting or absorbing luminescent radiation from this first luminescent layer. The optically variable structure need not completely prevent transmission of luminescent radiation from the first luminescent layer. Reflecting or absorbing enough luminescent radiation such that a significant difference results between images viewed by a user at normal and at a 45 degree viewing angle is sufficient. In some embodiments, the security device has an interface for emitting the luminescent radiation from the luminescent material wherein the optically variable structure is positioned between the luminescent material and the interface, so that in this arrangement, the optically variable structure transmits the luminescent radiation therethrough. Thus, in this embodiment, the optically variable structure functions as a wavelength selective filter which also selects the direction of transmission of luminescent radiation through the device based on wavelength. The interface may be an interface of the optically variable structure or another interface, for example, provided by a layer of material external of the optically variable structure.

In some embodiments, the material of the first luminescent layer may be disposed externally of the optically variable structure or device. In other embodiments, the luminescent material may be disposed internally of the optically variable device, and in yet other embodiments, the luminescent material may be partially disposed externally of the optically variable device and partially disposed within the optically variable device.

Configuring the security device with the luminescent material disposed externally of the optically variable structure or device may simplify the manufacturing process, increase the range of materials that can be used as the luminescent material and improve the ease with which properties or characteristics of the optically variable device and the luminescent material can be changed in the design and manufacturing process. For example, where the optically variable device is a multi-layer interference structure comprising layers of material having different refractive indices and precisely controlled thicknesses, which are typically fabricated using vapour deposition processes, it is not necessary to consider the effect of the luminescent material on the refractive index of a particular layer within the stack in the design process, which may limit the number of suitable luminescent materials that can be used. Furthermore, it is not necessary to modify the fabrication process to include luminescent material and control its thickness. As the fabrication process may involve high temperatures, high energy ions or deep UV and/or x-ray radiation, the luminescent material need not be limited to only those materials that can withstand the high temperatures involved, but can include many other materials, for example, organic materials.

In some embodiments, the luminescent material is in the form of one or more luminescent layers.

In some embodiments, the optically variable device comprises any one or more of an optical interference structure, a liquid crystal structure, a micro electrical mechanical system, a diffraction structure and a holographic structure.

In some embodiments, at least a portion of the optically variable structure is transmissive to visible light.

In some embodiments, at least a portion of the optically variable structure is adapted to control transmission of visible light therethrough and its direction based on the wavelength of the light.

In some embodiments, at least a portion of the optically variable structure is adapted to limit the wavelengths of visible light that can be transmitted therethrough (in any direction).

In one embodiment, the optically variable structure functions as a wavelength selective filter, in which the intensity of transmitted radiation depends on both wavelength and transmission/emission angle.

In some embodiments, the optically variable structure comprises a diffraction structure and a transmissive material spaced from the diffraction structure. The luminescent material is disposed between the diffraction structure and the transmissive material, wherein the transmissive material and/or the interface between the transmissive material and the luminescent material is adapted to reflect part of the luminescent radiation produced by the luminescent material towards the diffraction structure and to transmit part of the luminescent radiation therethrough, wherein the intensity of transmitted luminescent radiation is a function of wavelength of the luminescent radiation and angle of emission thereof from the security device.

In some embodiments, the diffraction structure comprises a reflective material. The diffraction structure may comprise a holographic diffraction structure.

In some embodiments, the optically variable structure comprises a reflector, an absorber and a support for enabling a spacing between the reflector and absorber to be varied, and the luminescent material is disposed between the reflector and the absorber, wherein the absorber controls the admittance of the reflector in response to changes in the spacing therebetween. The emissivity of the security device for luminescent radiation of various wavelengths may be varied by changing the spacing between the absorber and reflector. The spacing may be varied by any suitable means, including, for example, a variable mechanical, electrical or magnetic force.

In some embodiments, the optically variable structure comprises a plurality of members, adjacent members being spaced apart to provide a gap therebetween for the passage of luminescent radiation from the luminescent material for producing luminescent radiation.

In some embodiments, the optically variable structure comprises a first portion having an area which faces in a first direction and a second portion having an area which faces in a second direction different from the first direction, and wherein the luminescent means includes luminescent means in the first area which, when stimulated, emits luminescent radiation, and second luminescent means in the second area, which, when stimulated, also emits luminescent radiation. The luminescent radiation from the first and second luminescent means may be of different wavelengths.

In some embodiments, the luminescent material of the first luminescent layer which luminesces at the first wavelength has a boundary defining a first predetermined shape and the luminescent material of the second luminescent layer which luminesces at the second wavelength has a boundary defining a second predetermined shape. The first and second predetermined shapes may be the same or different. In some embodiments, the first and second predetermined shapes may either be arranged not to overlap one another, or to partially or fully overlap one another. These first and second predetermined shapes, when viewed by a user, form a complete image of the predetermined indicia.

In some embodiments, the optically variable structure comprises an optical interference structure. The optical interference structure may comprise a plurality of layers of material. In some embodiments, the optical interference structure comprises three or more layers of material in which each layer has a different refractive index to that of an adjacent layer.

BRIEF DESCRIPTION OF THE DRAWINGS

The embodiments of the present invention will now be described by reference to the following figures, in which identical reference numerals in different figures indicate identical elements and in which.

DETAILED DESCRIPTION

The present invention involves a security device which creates unique fluorescent imagery in which a portion of a predetermined indicia is visible when exposed to excitation or stimulation with a normal viewing angle. When similarly excited or stimulated and viewed at a different angle, the complete predetermined indicia, composed of the luminescent emission from the first indicia that was observed at normal viewing angle and the luminescent emission from a second indicia are now, is simultaneously visible to the user. In one embodiment of the invention, the different angle can be accomplished by tilting the security device.

Figure 1:
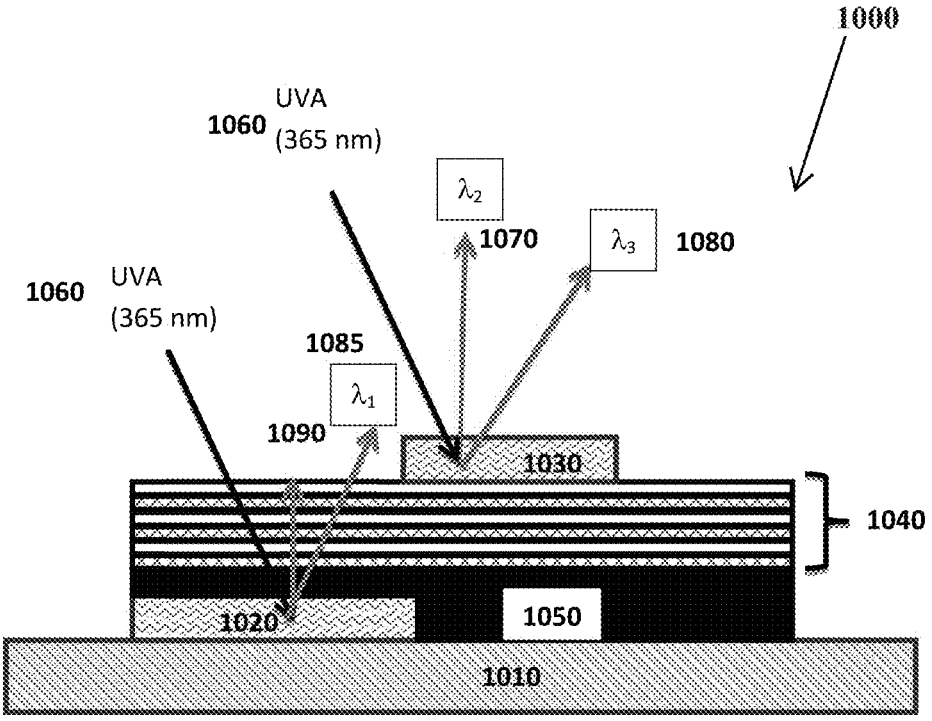
FIG. 1 shows a cross-sectional view of a security device according to one embodiment of the invention.

Referring to FIG. 1, a side cut-away view of one embodiment of the present invention is illustrated. The security device 1000 includes a substrate 1010, a first luminescent layer 1020, a second luminescent layer 1030, and an optically variable structure 1040. An adhesive 1050 may be used to adhere the security device to the structure 1040 and/or the first luminescent layer 1020 to the substrate 1010. When the luminescent layers 1020, 1030 are stimulated (in FIG. 1 these layers are stimulated by UV (ultra violet) radiation 1060), these layers luminesce. When the second layer 1030 luminesces, a user can see an incomplete image of a predetermined indicia. The incomplete image may be provided by the luminescence of the second layer 1030.

At a normal viewing angle, only the predetermined indicia from the second layer 1030 is visible. Luminescence of one or more wavelengths emits from the second layer 1030 at normal and tilted angles (see emitted radiation 1070, 1080) and the luminescent radiation from the second layer (1030) is observed to be the same color ($\lambda_2=\lambda_3$). At tilted angles, a previously hidden portion of the fluorescent indicia from the first luminescent layer 1020 (represented by emitted radiation 1085 $\lambda_1$) becomes visible to the user. This previously hidden or unseen portion completes the image of the predetermined indicia. The complete image of the predetermined indicia is a design composed of the visible luminescence from the second layer 1030 at an angled view (radiation 1080 $\lambda_3$) and the luminescence from the first layer 1020 and only visible at a tilted view ($\lambda_1$). The angular dependent fluorescent emission or luminescence from the first layer 1020 is controlled by the optically variable structure 1040. In one embodiment, the structure 1040 is a thin film colour-shift film or a multilayer polymer optical film. In one embodiment, on angular view or when the security device is viewed at a tilted angle, the fluorescent or luminescent emission of the indicia printed on each side of the thin film colour-shift appears to be of the same colour ($\lambda_1=\lambda_2=\lambda_3$).

It should be noted that the first layer 1020 also luminesces at a normal angle when stimulated by stimulating radiation. However, the optically variable structure 1040 reflects or attenuates this luminescence 1090 at a normal viewing angle such that it is not visible to the user.

Figure 1A:
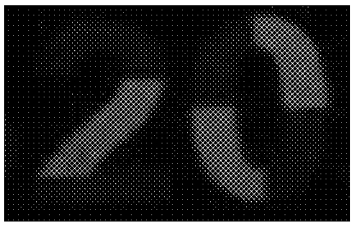
FIG. 1A illustrates an incomplete image of a predetermined indicia.
Figure 1B:
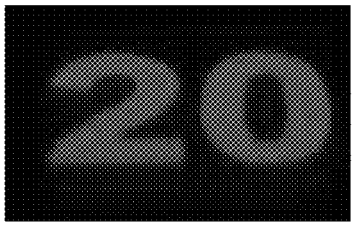
FIG. 1B illustrates a complete image of the predetermined indicia of FIG. 1A.

Referring to FIG. 1A, illustrated is an incomplete image of a predetermined indicia. Referring to FIG. 1B, a complete image of the same predetermined indicia is illustrated. As can be seen, the predetermined indicia in FIGS. 1A and 1B consists of the numbers 2 and 0. In FIG. 1A, only part of these numbers is visible to the user while in FIG. 1B, the complete image of the numbers is visible to the user. It should be noted that, on normal view (FIG. 1A), only the red fluorescent ink making up part of the puzzle is visible. When viewed from a tilted angle, the red fluorescent ink printed under the thin film colour-shift layer is revealed and completes the puzzle to show the number 20 (FIG. 1B).

It should be noted that the embodiment illustrated in FIG. 1 is a preferred one but it should not be taken as limiting the scope of the invention. Other configurations are, of course, possible. In FIG. 1, the substrate can be a banknote, a security document (e.g. an identity document, legal tender) or any other valuable document which may require authentication. In the figure, the optically variable structure may be a thin film colour-shift layer and is sandwiched between the first luminescent or fluorescent layer 1020 and the second luminescent or fluorescent layer 1030. In one embodiment, $\lambda_1=\lambda_3$ and, as such, the complete image of the indicia is of a single observed color.

In one embodiment, the thin film colour-shift layer is composed of vacuum coated transparent or semi-transparent dielectric layers with alternating material layers of high refractive index and low refractive index. In one variant, the optically variable layer 1040 may take the form of a multilayer polymer optical film. One example of such a film is described in U.S. Pat. No. 5,882,774 (Jonza el al.) and in U.S. Pat. No. 6,024,455 (O'Neill et al.). These references are hereby incorporated by reference.

It should also be noted that, in one variant, the fluorescent inks used in the luminescent layers can be of same body colour. Both layers can be configured to not have any optical absorption in the visible spectrum. This will produce a clear, colorless or white appearance prior to excitation or stimulation. The fluorescent ink printed on each side of the colour-shifting thin film is aligned so that on tilting, the visible fluorescent image appears as a complete image of an easily recognizable icon, number or image. The luminescent or fluorescent layers can be configured and positioned so that there is a high degree of registration between the fluorescent ink on each of the layers. With such a high degree of registration, a user can, by adjusting the viewing angle (e.g. by tilting the security device), see a complete image of the indicia. Of course, parts of the indicia are provided by one layer while the rest of the indicia is provided by the other layer.

In another variant, the fluorescent ink used on both the luminescent layers can be selected to have an exceptionally narrow fluorescent emission profile. With such an ink, the fluorescent emission can be selected to fall completely outside the transmission profile of the colour-shift thin film (the optically variable structure) on the normal angle. This fluorescent emission can be equally selected to fall completely within the transmission profile of the thin film at a 45 degree viewing angle. By doing so, the fluorescent emission colour of the fluorescent ink printed on the first layer 1020 will match the fluorescent emission of the fluorescent ink on the second layer 1030. This gives the result that $\lambda_1=\lambda_2=\lambda_3$.

For the embodiment in FIG. 1, if the emission profile of the fluorescent ink on the first layer 1020 is broader than the transmission profile of the colour-shifting thin film 1040, there will be some filtering of the fluorescent emission spectrum and thus the observed colour for the fluorescence for the complete image of the indicia will not match. When viewing the two layers at a tilt angle, there may be an observable colour difference between the fluorescence produced by the first layer and the fluorescence originating from the second layer (i.e. $\lambda_1\neq\lambda_3$). In addition, when using broad fluorescent emitters, it might be difficult to construct a fluorescent puzzle feature in which the indicia portion on the first layer is completely hidden from view on normal viewing.

Experiments have shown that the variant illustrated in FIG. 1 works best with narrow emission profile fluorescent inks. This feature adds to the security of the device by limiting the type of fluorescent inks that a counterfeiter may use to simulate the feature.

In yet another variant, the fluorescent ink on the second layer may be selected such that its fluorescence matches the fluorescent ink of a broad band fluorescent emitter on the first layer. For this variant, the two fluorescent inks used on the first and second fluorescent or luminescent layers are not composed of identical fluorescent pigments. However, when both layers luminesce or fluoresce, the fluorescence from the first layer, after having a portion of its fluorescence filtered by the optically variable structure, is similar if not equal to the fluorescence from the second layer. As such, $\lambda_1=\lambda_3$ and the complete image of the indicia viewed by the user (at a tilt angle) has a single color.

Figure 1C:
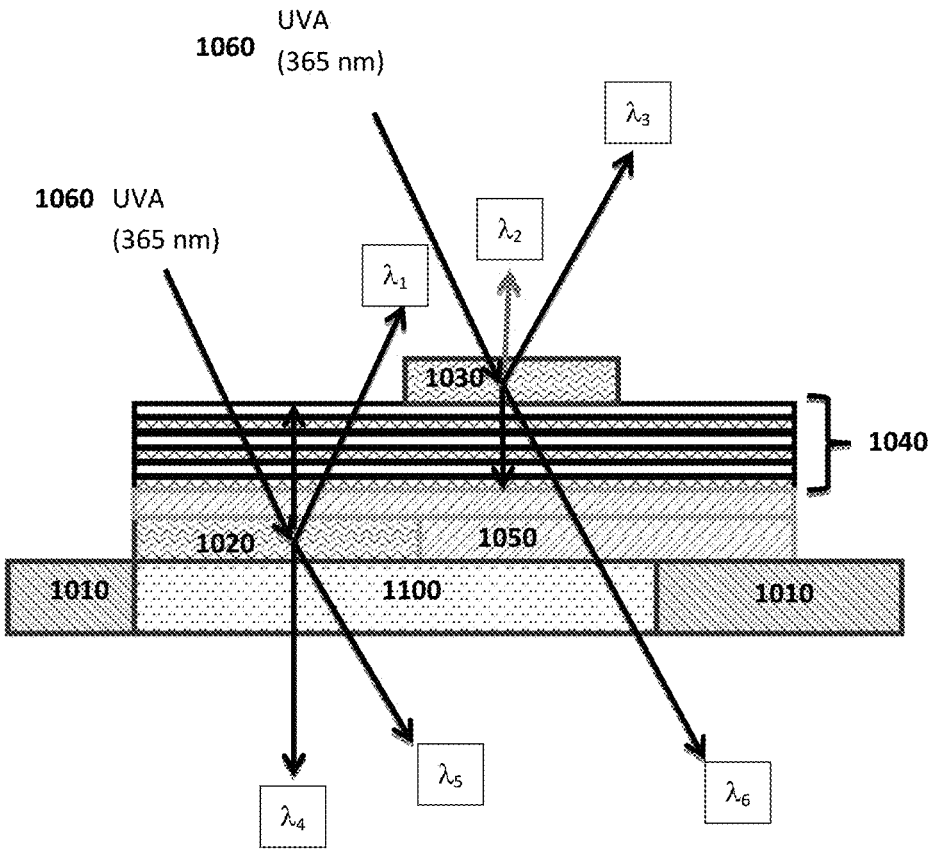
FIG. 1C illustrates a variant of the security device in FIG. 1 where a specific type of puzzle feature is used with a transparent window area on a substrate.

A further variant of the security device in FIG. 1 is shown in FIG. 1C. As shown in FIG. 1C, this security device with a specific type of puzzle feature could be used with a transparent window area (1100) on a substrate 1010. With this configuration, on one side of the substrate, angled or titled viewing would result in a view of a complete image of the indicia appearing to have the same fluorescent emission colour ($\lambda_1=\lambda_3$) as explained above in relation with FIG. 1. On the other side of the substrate (e.g. a banknote), the complete image of the indicia will also appear to a user when viewed at an angle. However, this complete image of the indicia, when viewed on the other or bottom side, will not have the same colors as the complete image viewed from the top side. Thus, from FIG. 1C, $\lambda_4=\lambda_3\neq\lambda_6$ since the second layer 1030 does not contain the necessary fluorescent pigments to match the unfiltered fluorescent emission of the broad band emitter (1020).

It should be noted that the embodiments illustrated in FIGS. 1 and 1C may be combined with holographic and/or demetallized patterns.

Figure 2A:
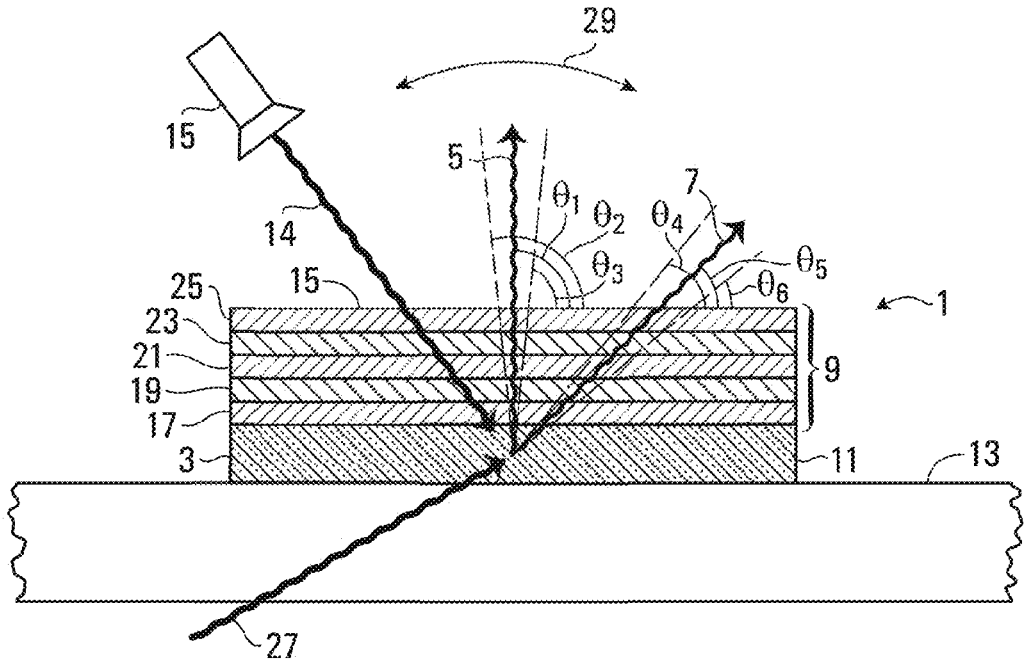
FIG. 2A shows a cross-sectional view through a security device according to an embodiment of the present invention.

Referring to FIG. 2A, a variant of the present invention is illustrated. For this variant, the luminescent material luminesces at specific wavelengths and, for at least one wavelength, a user sees a completed image of the predetermined indicia. For at least one other wavelength, the user sees an incomplete image of the indicia. In this particular embodiment, the luminescent material is formed as a layer 11 on a substrate 13 such as a bank note, credit card or document. The luminescent layer 11 may comprise a mixture of two luminescent substances each of which luminesces at a different wavelength in the visible spectrum when irradiated with stimulating radiation, for example, ultraviolet (UV) light from a suitable UV light source 15 or other radiation from a suitable source. The luminescent layer may comprise an ink or lacquer containing luminescent pigments and may be applied to the substrate using any suitable printing, coating or other deposition technique. Alternatively, the luminescent layer may be applied to the optically variable device 9 and secured to the substrate using a suitable adhesive.

In one embodiment, the optically variable device 9 is positioned over a luminescent layer 11 and transmits the luminescent radiation therethrough to a solid-to-air interface 15 from which the luminescent radiation is emitted at different angles of emission depending on its wavelength.

In one variant, the first luminescent layer (located beneath the optically variable structure) luminesces to produce a first image visible to a user only at specific angles. The second luminescent layer (located atop the optically variable structure) luminesces to produce a second image. The first image may have a first color and the second image may have a second color. When both images are visible to a user at a first range of specific angles, a third completed image is visible to the user. The third image is a combination of the first and second images and is a complete image of a predetermined indicia while both the first and second images are incomplete (but complementary) images of this indicia. The first color may match the second color and the third image may have a color that matches the first and second colors.

It should be noted that the first range of specific angles noted above refers to a range of angles at which both the first and second images are visible to a user.

The optically variable device may be adapted to control transmission of the luminescent radiation therethrough based on the wavelength of the radiation. In particular, the optically variable device is responsive to the wavelength of luminescent radiation to control the direction of transmission of the luminescent radiation through the device depending on its wavelength. The optically variable device may comprise any suitable device adapted to perform this function.

In the embodiment of FIG. 2A, the optically variable device is also transmissive to the excitation radiation used to stimulate luminescence emission from the luminescent material so that the excitation radiation can be applied to the same side of the optical security device from which the luminescent radiation is emitted. To effect transmission of the excitation radiation, the materials of the optical stack may be selected to have relatively low absorption at the wavelength(s) that stimulate the luminescence. Materials which have relatively low UV absorption at wavelengths of some UV stimulated luminescent materials include zirconium oxide ($ZrO_2$) and silicon oxide ($SiO_2$), $ZrO_2$ having a relatively high refractive index, and $SiO_2$ having a relatively low refractive index. In one embodiment, the first, third and fifth layers 17, 21, 25 each comprises $ZrO_2$, and the second and fourth layers 19, 23 each comprises $SiO_2$.

In some embodiments, the optical interference stack may comprise three or more layers having alternating relatively high and relatively low refractive indices, for example, any number of layers in the range of 3 to 15 or more.

Generally, the performance of the optical interference stack in terms of limiting transmission of only certain wavelengths and limiting the range of angles over which a wavelength is transmitted, depends on how the structure is modelled. At the interface between different layers, a certain amount of light will be transmitted, and a certain amount reflected back into the originating layer, the amount reflected back increasing with the difference in the refractive indices of the two layers. The light which is reflected back interferes both constructively and destructively with light in the layer, resulting in the selectivity of the transmission angle and wavelength(s) supported for transmission to the next layer and ultimately through the optical structure.

Thus, generally, as the difference in the refractive indices between adjacent layers increases and/or as the number of layers increases, the range of angles over which each luminescent spectral component is emitted from the optically variable device becomes narrower, the emission direction better defined, and the component becomes more monochromatic. Thus, depending on the number of layers and their relative refractive indices, the optical security device can be designed to produce a gradual shift from one colour to another as the emission angle is changed, or a sharp, e.g. digital-like change or switch from one colour to another. In the former case, the optically variable device may support both transmission of first and second colours each at a respective different emission angle and one or more other colours resulting from mixing of the first and second colours at a respective different emission angle, for example between the two emission angles of the first and second colours. Thus an observer will see a colour shift from the first colour to a mixture of both colours to the second colour, or vice versa, as the viewing angle is changed. For example, if the first colour is red and the second green, a colour shift of red to orange to green or vice versa will be observed. It should be noted that the color shift can be configured such that, as the color shift is occurring, the user views an image that is progressively being completed.

Depending on the selectivity of the optically variable structure, it may not be possible to completely eliminate the second colour component from the first colour component at the emission angle which favours the first colour. Similarly, it may not be possible to completely eliminate the first colour component from the second colour component at the emission angle which favours the second colour.

The performance of the optical security device also depends on how well the colours emitted by the luminescent material are matched to the colours which are transmitted by the optically variable structure. If the colours are well matched, the luminescence emission will generally appear brighter than if the colours are poorly matched. Also, depending how well the colours are matched, increasing the number of layers in the optical structure may affect the brightness of the luminescence emission. In particular, increasing the number of layers tends to narrow the band of wavelengths that can be transmitted. If the luminescent material emits over a wider band, only part of the available luminescence will be transmitted.

As the number of layers in the optical structure increases, absorption of the excitation radiation (e.g. UV light) may increase, in which case, there will be a trade-off between increasing the number of layers to obtain a better defined luminescent emission characteristic and decreasing the number of layers to reduce absorption of excitation light. In addition, for materials which are relatively absorbing of the excitation light, fewer layers may be used in comparison to an optical stack formed of layers which are relatively transmissive to the excitation light.

In other embodiments, which contemplate stimulating the luminescent material by applying excitation light from another direction to avoid transmission through the optically variable device, for example, from the other side of the substrate 13, as indicated by arrow 27 in FIG. 2A, absorption by the optical stack of excitation light need not be considered when designing the optical stack.

In some embodiments, the interference layers of the optical stack may be configured so that the layer or layers with a higher refractive index have a thickness corresponding to ¾ wavelength of a targeted wavelength for the optical reflectance spectrum and the layer or layers with a lower refractive index have a thickness corresponding to ¾ wavelength. Thus, in the embodiment where the optical stack comprises alternating layers of $ZrO_2$ and $SiO_2$, the $ZrO_2$ layers have a thickness of ¾ wavelength and the $SiO_2$ layers have a ¾ wavelength thickness. This configuration also contributes to the efficiency of the fabrication process, in that the deposition rate of SiO2 or other low index material, which forms the thicker layer is generally higher than the deposition rate of $ZrO_2$ or other high index material.

Figure 2B:
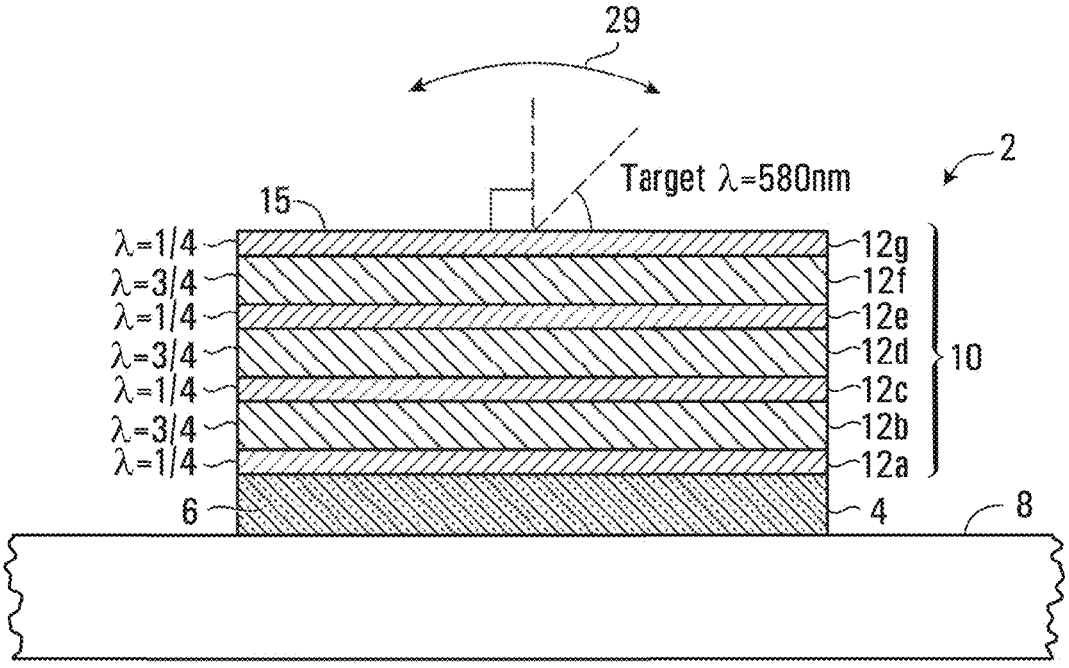
FIG. 2B shows a cross-sectional view through a security device according to another embodiment of the present invention.

A specific embodiment of a configuration which can be used with the invention will now be described with reference to FIGS. 2B and 3. This example is included herein for illustrative purposes only and is in no way limiting of the invention. Referring to FIG. 2B, a security feature 2 comprises a luminescent material 4 formed as a layer 6 above a substrate 8 with an optically variable structure 10 positioned above the luminescent layer. The optical stack can be seen to include the luminescent material and the optically variable structure. The optical structure is formed of seven layers of alternating high and low refractive index materials 12*a* to 12*g* with the lowermost layer 12*a* and each alternating layer 12*c*, 12*e* and 12*g* being formed of a high refractive index material and the second, fourth and sixth layers 12*b*, 12*d*, 12*f* being formed of a low refractive index material. In this specific example, the high refractive index material forming the first, third, fifth and seventh layers 12*a*, 12*c*, 12*e* and 12*g* is $ZrO_2$ which has a refractive index, n, of 2.05 at 550 nm and the low refractive index material forming the second, fourth and sixth layers 12*b*, 12*d* and 12*f* is $SiO_2$, which has a refractive index, n, of 1.45 at 550 nm. In designing the stack, a required characteristic in the optical performance of the stack is defined. One particular characteristic is the wavelength of light for which the transmissivity by the optical stack is a minimum at an emission angle of 90° to the surface. Having defined the "target" wavelength, the thickness of the layers in the optical stack can be determined. In particular, the thickness, t1 of the ¼ wavelength layers can be determined from the equation:

$$t_1 = \frac{\lambda}{4n_1},$$

where λ is the target wavelength and n1 is the refractive index of the ¼ wavelength layer.

The thickness of the ¾ wavelength layer $t_2$ can be determined from the equation:

$$t_2 = \frac{3\lambda}{4n_2},$$

where $n_2$ is the refractive index of the ¾ wavelength layer.

In this specific example, a target wavelength λ=580 nanometers is selected. From the above equations, the target thickness of the ¾ wavelength $ZrO_2$ layer, $t_1$=70.67 nanometers, and the target thickness of the ¾ wavelength $SiO_2$ layer, $t_2$=298.20 nanometers.

Figure 3:
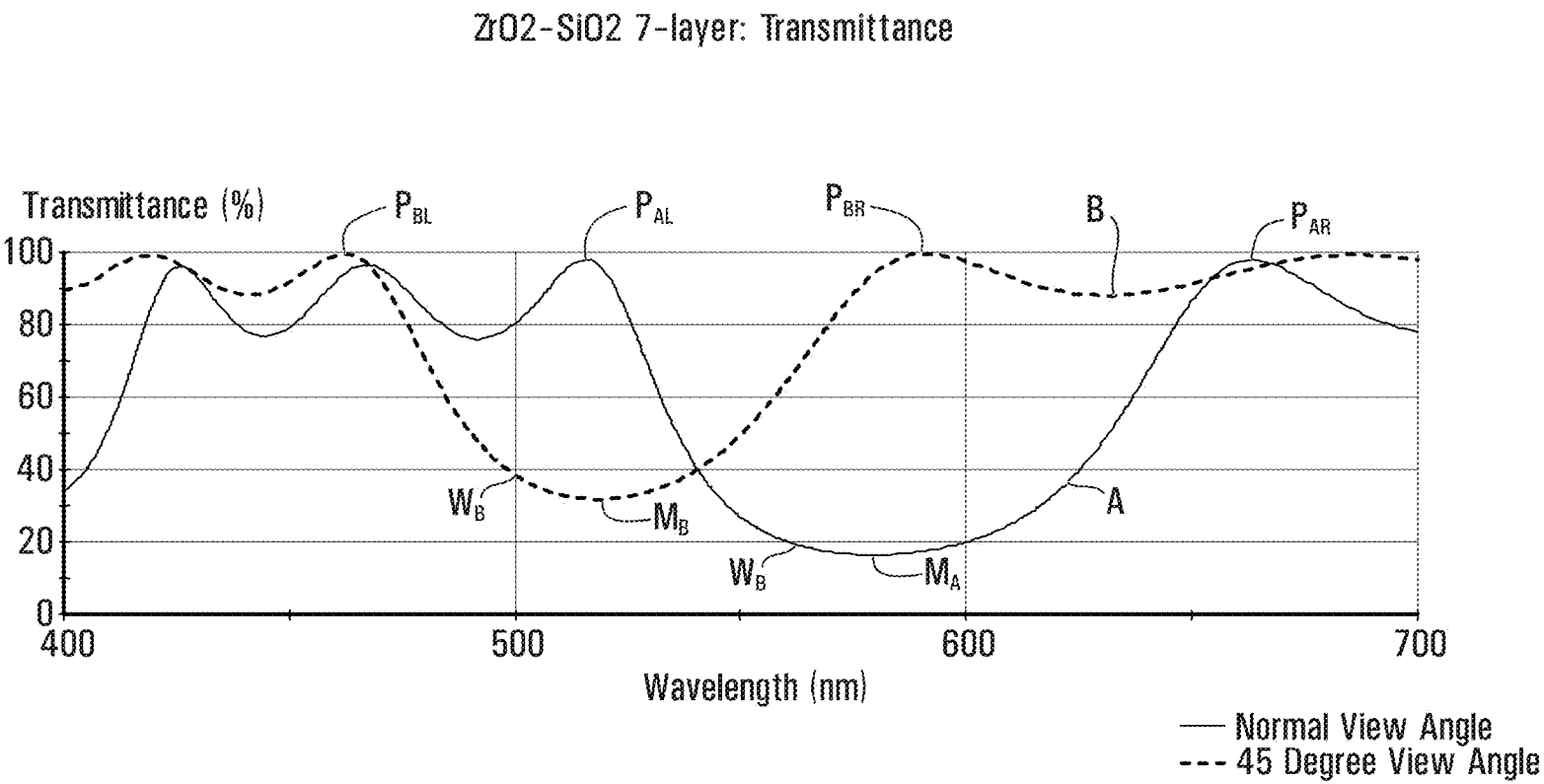
FIG. 3 shows an example of a graph of transmittance as a function of wavelength for the optically variable structure of the embodiment shown in FIG. 2.

FIG. 3 is a graph of transmittance as a function of wavelength showing the optical response of the optical stack of FIG. 2B for both a viewing angle which is normal to the upper surface 15 of the optical stack, indicated by the solid line curve A, and a viewing angle of 45° to the upper surface 15 of the optical stack, as indicated by the broken line curve B. The optical response of the seven layer stack of FIG. 2B was modelled by Concise MacLeod Software (version 8.16.196) by Thin Film Center Inc., Tuscon, Ariz. U.S.A.

As can be seen from the graph at normal viewing angle (curve A), the transmittance of the stack has a minimum value of about 20% at a wavelength of about 600 nanometers, corresponding to red light, and has a maximum value of about 98% for a wavelength of about 520 nanometers, corresponding to green light. Conversely, at a 45° viewing angle (curve B), the optical stack has a transmittance of about 92% for a wavelength of 580 nanometers (red light), and a transmittance of about 32% for a wavelength of 520 nanometers (green light). Thus, the transmittance of the optical stack at normal viewing angle is significantly greater for green light than for red light and at a 45° viewing angle the transmittance is significantly greater for red light than for green light. The optical stack may be used as either or both the first or second luminescent layer. Of course, since the luminescence from the first luminescent layer is filtered by the optically variable structure, the structure and luminescence characteristics of the first luminescent layer may be different from the structure and luminescent characteristics of the second luminescent layer. Preferably, the luminescence from the first luminescent layer, after passing through the optically variable structure, matches the luminescence from the non-filtered luminescence from the second luminescent layer. A match between the filtered luminescence of the first layer and the unfiltered luminescence of the second layer would provide a more color coordinated completed image of the predetermined indicia as the completed image would not have any color shifts between the portions from the first layer and the portions from the second layer. This would provide for a more effective security device.

It should be noted that the following discussion assumes the use of the optical stack for the second luminescent layer illustrated in FIG. 1. Should the optical stack be used for the first luminescent layer, the resulting observable luminescence after being filtered by the optically variable structure would depend on the qualities and characteristics of the optically variable structure.

It should also be noted that an optical stack can be used to produce a more colorful security device. Given a luminescent material which is capable of emitting luminescence at the appropriate wavelengths, the combination of the optical stack and the luminescent material can be used for the second luminescent layer to enable a colour change from green, at normal viewing angle, to red, at a 45° viewing angle, to be observed. In general, the luminescent material is adapted to emit a first colour or wavelength for which, at a first viewing angle, the optical stack has a relatively high transmittance, and to emit a second colour or wavelength for which, at the same angle, the transmittance of the optical stack is relatively low; and where at a second viewing angle, the transmittance of the optical stack for the second colour or wavelength is relatively high, and at the same angle, the transmittance of the optical stack for the first colour or wavelength is relatively low. In the present example, the luminescent material may be selected to emit one or more wavelengths in the green part of the optical spectrum where the transmittance at normal viewing angle is in the region of a maximum, for example in the range 510 to 525 nanometers, and to emit one or more wavelengths in the red part of the visible spectrum in the region where the transmittance is a maximum at a 45° viewing angle, for example in the range of 600 to 610 nanometers. Due to the non-zero transmittance of the optical stack at normal viewing angle for red light, some red luminescence will be transmitted through the optical stack at normal viewing angle with the green luminescence. However, the green luminescence will dominate. Similarly, for a 45° viewing angle, due to the non-zero transmittance of the optical stack for green light, some green luminescence will be transmitted through the optical stack with the red luminescence. However, the red luminescence will dominate. In the event the optical stack is used for the first luminescent layer, the luminescence at different angles will produce difference colors depending on the characteristics of the optically variable structure.

It will be noted that the optical response curves A and B of FIG. 3 both have similar shapes, each having left and right-hand peaks PAL, PAR, PBL, PBR separated by a trough or well WA, WB each having a minimum MA, MB. As the viewing angle changes from normal to 45°, curve A is effectively shifted to the left, i.e. the left and right-hand peaks PAL, PAR and the minimum MA are shifted to shorter wavelengths. Thus, what was a minimum transmittance for red light at normal viewing angle becomes a minimum transmittance for green light at a 45° viewing angle, and what was a maximum transmittance for green light at normal viewing angle becomes a maximum for transmittance for red light at a 45° viewing angle. In the present example, the sides of the trough or well both have a finite slope, and the bottom of the well is curved and has a non-zero minimum. These characteristics will give rise to the transmission of finite amounts of different colours within the spectral range of the trough or well if produced by the luminescence material. One method of limiting the number or range of colours emitted by the second luminescent layer at any particular emission angle would be to design the optical stack so that the sides of the trough or well are relatively vertical, the well is deep (e.g. approaches zero transmittance) and the bottom is relatively flat. Another method is to limit the number of colours that can be emitted by the luminescent material, when stimulated. For example, the luminescent material may be designed only to emit green and red light having a respective wavelength or number or range of wavelengths.

In another example, in addition to exhibiting an angle dependent colour between first and second colours or wavelengths, luminescent layers, and especially the second luminescent layer, may be adapted to emit a third colour with either no or little angular dependence. With reference to FIG. 3, the luminescent material of the second luminescent layer may be adapted to emit blue light in addition to green and red light. As can be seen from curves A and B, there is little angular dependence in the transmittance of light for wavelengths below about 460 nanometers as the viewing angle changes from normal to 45°. Thus, the second luminescent layer can be arranged to emit blue light at both normal and 45° viewing angles. The first luminescent layer can also be arranged in a similar manner but the resulting observable emission may be different due to the filtering effect of the optically variable structure.

Referring to FIGS. 2A and 2B, the second luminescent layer 11 produces a luminescent colour shifting effect when stimulated with the UV light source. When used in the second luminescent layer, the colour-shift is caused by the interaction of the light generated by the luminescent material in the optically variable device 9, 10. As a result, a person using this feature to authenticate a bank note, for example, would observe that the colour of the light being emitted by the luminescent image changes as the bank note is tilted back and forth as indicated by the arrow 29. Thus, in addition to authentication by viewing a completed image of the predetermined indicia, authentication can also be performed by observing the emitted colours, the angle of emission and the order in which the colours appear as the security device is tilted back and forth. As well, authentication can be done by comparing any one or more of these characteristic(s) with a known criteria. In some embodiments, the colour shift may involve only two colours whereas in other embodiments, three or more angle-dependent colours may be encoded into the security device. A wide range of colour pairs for the colour shift can be generated depending on the choice of luminescent material, e.g. inks or pigments, and the design of the optically variable stack. In some embodiments, the luminescent material comprises a mixture of different coloured pigments to produce an overall emission spectrum that is tailored to match the colour-shifting properties of the optically variable device.

In embodiments in which the optically variable structure comprises an optical interference structure formed of alternating layers of high and low refractive index materials, a number of different materials may be suitable for the high and low refractive index layers. Non-limiting examples of high refractive index materials which may be suitable include: zirconium oxide ($ZrO_2$), titanium dioxide ($TiO_2$), indium oxide ($In_2O_3$), indium-tin-oxide (ITO), magnesium oxide (MgO), tantalum pentoxide ($Ta_2O_5$), carbon (C), ceric oxide ($CeO_2$), yttrium oxide ($Y_2O_3$), europium oxide ($Eu_2O_3$), iron oxides, for example (II)diiron(III) oxide ($Fe_3O_4$) and ferric oxide ($Fe_2O_3$), hafnium nitride (HfN), hafnium carbide (HfC), hafnium oxide ($HfO_2$), lanthanum oxide ($La_2O_3$), neodymium oxide ($Nd_2O_3$), niobium pentoxide ($Nb_2O_5$), praseodymium oxide ($Pr_6O_{11}$), samarium oxide ($Sm_2O_3$), antimony trioxide ($Sb_2O_3$), silicon carbide (SiC), silicon nitride ($Si_3N_4$), silicon monoxide (SiO), selenium trioxide ($Se_2O_3$), tin oxide ($SnO_2$), tungsten trioxide ($WO_3$), zinc sulfide (ZnS), zinc oxide (ZnO) and/or other high index materials, or combinations thereof.

Non-limiting examples of low refractive index materials which may be suitable include: silicon dioxide ($SiO_2$), aluminum oxide ($Al_2O_3$), metal fluorides, including, for example, aluminum fluoride ($AlF_3$), barium fluoride ($BaF_2$), calcium fluoride ($CaF_2$), cerium fluoride ($CeF_3$), lanthanum fluoride ($LaF_3$), magnesium fluoride ($MgF_2$), neodymium fluoride ($NdF_3$), sodium aluminum fluorides (e.g., $Na_3AlF_6$ or $Na_5Al_3F_{14}$), samarium fluoride ($SmF_3$), lithium fluoride (LiF), and/or other low index materials or combinations thereof. Other suitable low index materials may include organic monomers and polymers, including dienes or alkenes such as acrylates (e.g., methacrylate), perfluoroalkenes, polytetrafluoroethylene (Teflon), or fluorinated ethylene propylene (FEP).

The suitability of the material for the high and low index layers may depend on their ability to transmit electromagnetic radiation therethrough at the wavelength(s) of the luminescent stimulating radiation. It is to be noted that in some embodiments, the optically variable device or structure may comprise layers which are all formed of either relatively high or relatively low refractive index materials, with the difference in refractive index between adjacent layers being relatively small.

In some embodiments, the optical interference stack may comprise three or more layers of material. The upper layer may be either the higher refractive index material or the lower refractive index material depending on the implementation. For example, where the upper layer interfaces with air, and a relatively high reflection at the interface is beneficial, the upper layer may be formed of a higher index material, for example. Similar considerations may be applied to the lowermost layer of the optical stack. The uppermost and lowermost layer may both be higher or lower index materials or one may be a higher index material and the other a lower index material. The number of layers in the optical stack may be odd or even.

In other embodiments of the security device, the optically variable structure is adapted to control luminescent emission of only one wavelength and not to control luminescent emission from the security device of other wavelengths. For example, returning to FIG. 2A, a luminescent layer 11 may be adapted to produce luminescence of one wavelength and not of another wavelength. The security device may include luminescent material above the optically variable structure 9 which luminesces. The optically variable structure may be adapted not to control emission of luminescent radiation from this upper layer. In this arrangement, when stimulated with a suitable source of stimulating radiation, luminescence from the upper layer is emitted without the optically variable structure controlling the direction of emission thereof, and therefore the emissivity of luminescent radiation from the upper layer may be similar at all angles, for example. On the other hand, the angle dependent emissivity from the security device of luminescent radiation originating in the lower layer 11 is controlled by the optically variable structure 9 and therefore the intensity of luminescence originating from the lower layer exhibits an angle dependence. The optically variable structure may be arranged so that the emissivity of the security device for luminescence from the lower layer is relatively high for a predetermined angle or range of angles and is substantially reduced at other angles. In this case, for the predetermined angle or range of angles which favours emission of luminescence from the lower layer from the security device, the observed colour will be the additively effective of the wavelengths emitted. At emission angles where the emissivity of the security device for luminescence from the lower layer 11 is reduced, the observed colour will be dominated by luminescent emission from the upper layer above the optically variable structure. Accordingly, a change in colour of emitted luminescent radiation will be observed as the security device is tilted or the observation angle relative to the security device otherwise changed.

Another aspect of the present invention provides a security device which includes an optically variable structure or device having first and second opposed electromagnetic radiation transmissive interfaces, an electromagnetic radiation transmissive medium between the first and second interfaces, and control means, e.g. structure, for controlling the intensity, direction and wavelength of radiation emitted from one of the first and second interfaces that is passed through the other of the first and second interfaces and the medium. In some embodiments, the security device may be transmissive to electromagnetic radiation in the visible spectrum and provide an angle-dependent colour-shift effect on the emission side for light transmitted through the device from the other side. The color-shift effect, when used in conjunction with a second layer of luminescent material adjacent to the optically variable device, may be used to provide a user with a completed image of the predetermined indicia. For this embodiment, the second layer of luminescent material provides an always visible view of an incomplete image while the color-shift effect, when active, completes the image. Explanations regarding the configurations for the color-shift effect are found in U.S. patent application Ser. No. 13/203,389 in reference to FIGS. 4 to 6 of that application, the entirety of which is hereby incorporated by reference. As can be imagined, the color-shift effect and the second layer of luminescent material may be configured such that a user viewing the structure and the second layer of luminescent material will see a completed image of the predetermined indicia only at certain angles or range of angles.

The security device may therefore provide an angle-dependent chromatic filter. While the above discussion mentions features and components of the security device being located on one side of a substrate, in other embodiments, the security device may also provide a similar effect when viewed from the other side of the substrate. In such embodiments, when visible light is directed towards the second interface through the substrate, the optically variable device controls the direction and wavelength of light through the device to substantially limit emission from the first interface at one angle to light having a first wavelength or colour, and to substantially limit emission from the second interface at another angle, to light having a second wavelength or colour.

In other embodiments, the transmissivity and emissivity of the security device for light of different wavelengths or colours may be substantially the same.

It should be noted that the light source may be natural ambient light or light from an artificial source, for example, a lamp. In other embodiments, the various second wavelengths or colours may be outside the visible range, for example UV or IR.

The angle-dependent colour-shift of transmitted visible light and how this provides a completed image of the predetermined indicia produces a security feature which can be detected and authenticated by a person. On the other hand, the angle-dependent colour-shift for light outside the visible range can be detected by a suitable detector for authentication.

Advantageously, the same optically variable device can produce both colour shifting effects for luminescent radiation and colour shifting effects for transmitted visible light. This allows both attributes to be readily combined and incorporated into the same security device for use in conjunction with a transparent substrate.

Figure 4:
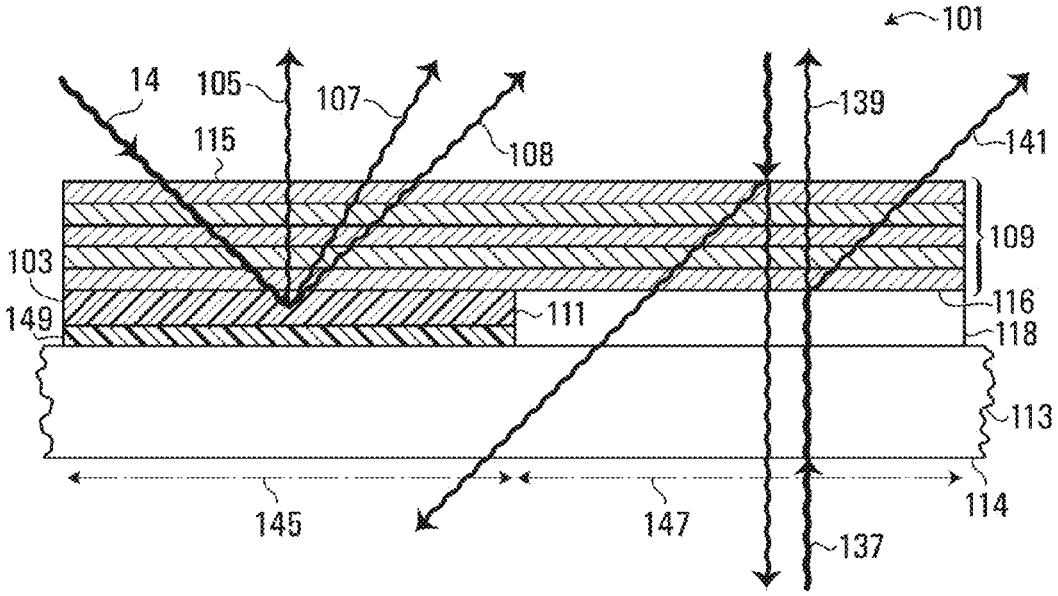
FIG. 4 shows a cross-sectional view of a security device according to another embodiment of the present invention.

FIG. 4 shows an embodiment of a security device having both a luminescent emission angle-dependent feature and a transmitted light angle-dependent feature positioned in side-by-side relationship.

Referring to FIG. 4, the security device 101 comprises a layer 111 of luminescent material 103 and an optically variable structure or device 109 positioned above the luminescent layer. The security device is positioned above and secured to a substrate 113. The security device includes two lateral regions 145, 147 and the optically variable structure extends over both regions. In this embodiment, one luminescent layer extends over the first region 145 only while another luminescent layer, with different characteristics from the first region 145, extends over second region 147. A further layer 149 may be provided between the luminescent layer and the substrate for absorbing or reflecting light in the visible spectrum. The absorber or reflector layer 149 extends over the first lateral region 145 only. The entire substrate 113 may comprise a transparent or translucent material or may comprise a transparent material in the second lateral region 147 (or over a portion thereof) and an opaque or relatively opaque material over the first lateral region 145.

The optically variable device 109 may comprise a multi-layered interference structure as described above with reference to FIGS. 2A and 2B, for example.

When a suitable source of excitation radiation 14 is directed towards the luminescent layer 111 from the upper side 115 of the security device, the device emits from the upper side 115, luminescent radiation 105 having a first colour at a first emission angle and luminescent radiation 107 having a second colour at a second emission angle. Optionally, the security device may be arranged to emit luminescent radiation 108 having a third colour at a third angle. Luminescent radiation emitted from the first region at a first specific range of angles may provide the user with a view of an incomplete image of the predetermined indicia. Luminescent radiation from the luminescent layer from the second region at a second specific range of angles also provides the user with an incomplete image. However, when luminescence from both regions are visible to a user, this provides the user with a complete view of the predetermined image. As can be imagined, there is overlap between the first and second specific range of angles and, at this overlap, the user is presented with the complete image. The complete image may be multichromatic with part of the image having a color dependent on the radiation from the first region while part of the image has a color dependent on radiation from the second region. Alternatively, the completed image may be monochromatic with a single color being based on luminescence from both first and second regions.

When the security device is illuminated by light 137 directed towards a transparent portion of the lower side 114 of the substrate 113, the security device emits visible light 139 from the upper side 115 at a first angle and emits visible light 141 from the upper side of another colour at another angle. A similar effect for visible light may be observed when the light is transmitted in the opposite direction and the emitted light is observed from the underside 114 of the substrate 113, as shown by the arrows. This characteristic of the security device may be used by having an incomplete image of the predetermined indicia be visible to a user viewing from the upper side at a first angle. At a second angle, a complete image of the predetermined indicia can be viewable to a user if the security device is configured by judiciously locating specific regions of the optically variable structure such that the other color shows the complete image.

It is to be understood that the optically variable device in the second region may be directly adjacent the upper surface of the substrate or a transparent spacer layer 118 may be provided in this region.

It should be noted that the predetermined indicia may have any shape or form, and each angle-dependent luminescent and transmitted colour may be any colour, as required.

In another embodiment, a security device having both luminescent emission colour shift and ambient transmissive colour shift can provide both a human assisted security device and a human unassisted security device. This enables the security device to be authenticated by two key types of security users. In addition, the optically variable device or structure, which may comprise a relatively hard film, provides additional protection for the luminescent feature making it more durable. This is particularly advantageous for bank notes which are subjected to daily wear and tear through circulation and handling. In some embodiments, a transparent substrate material, coating or layer may be provided below the luminescent layer for protection thereof.

Various methods of fabricating a security device and applying the security device to a substrate will now be described with reference to FIGS. 5A to 5E and FIGS. 6A to 6E.

FIGS. 5A to 5E show a configuration in which the security device is secured to a foil, and the foil and security device subsequently transferred to a substrate such as a bank note.

Figure 5A:
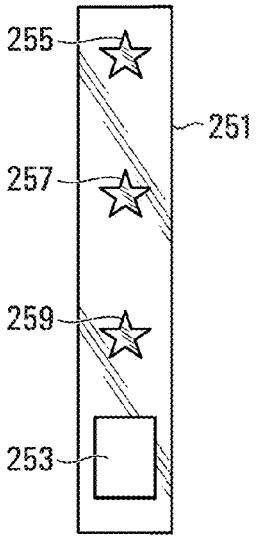
FIG. 5A shows a plan view of a foil to which an optical security device can be applied.

Referring to FIG. 5A, a foil 251 is provided having a window area 253. The foil may optionally contain one or more other security features 255, 257, 259 such as a hologram or other DOVID (Diffractive Optical Variable Image Device) type features.

Figure 5B:
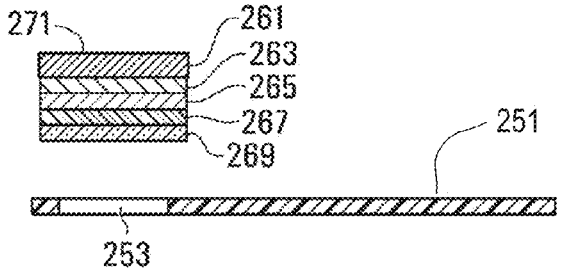
FIG. 5B shows a cross-sectional view through a foil and an optical security device according to an embodiment of the present invention.
Figure 5C:
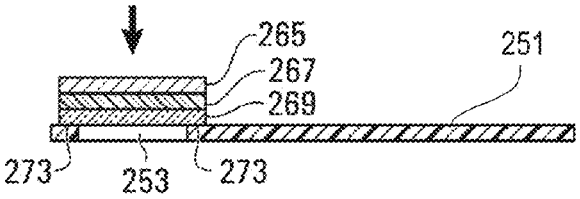
FIG. 5C shows a cross-sectional view through the optical security device and foil of FIG. 5B when the security device is mounted to the foil.

Referring to FIG. 5B, a carrier web 261 formed of any suitable material such as PET is provided having a release layer 263. Successive layers of material forming an optically variable structure 265 are deposited onto the release layer side of the carrier web 261, using any suitable conventional deposition process such as PVD (physical vapour deposition), CVD (chemical vapour deposition), PECVD (plasma enhanced chemical vapour deposition), sputtering or any other suitable technique. The resulting optical thin film structure typically has a thickness of less than 1 micron. Next, a luminescent ink layer 267 is deposited onto the optical thin film 265, followed by application of an adhesive layer 269, which may be a hot foil transfer adhesive. The luminescent ink layer may have a typical thickness in the range of 1 to 2 microns, for example, and the adhesive layer may have a typical thickness of about 1 micron. A discrete area 271 of the resulting structure is removed, e.g. cut from the web and applied as a patch to the foil 251 over the demetallized window area 253, and is secured to a perimeter area or margin 273 surrounding the window 253, by means of the adhesive layer 269. The web carrier and release coating are removed from the optical thin film layer resulting in a foil containing the optical security device with the optical thin film 265 uppermost, and containing any other optional, selected security features, as shown in FIG. 5C.

Figure 5D:
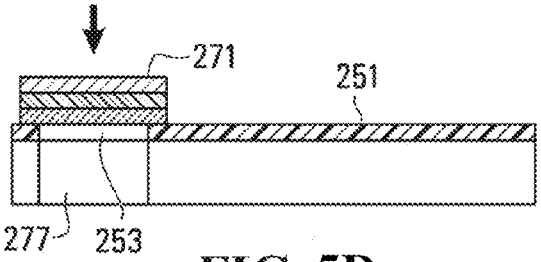
FIG. 5D shows a cross-sectional view through the optical security device and foil combination shown in FIG. 5C mounted to a substrate.
Figure 5E:
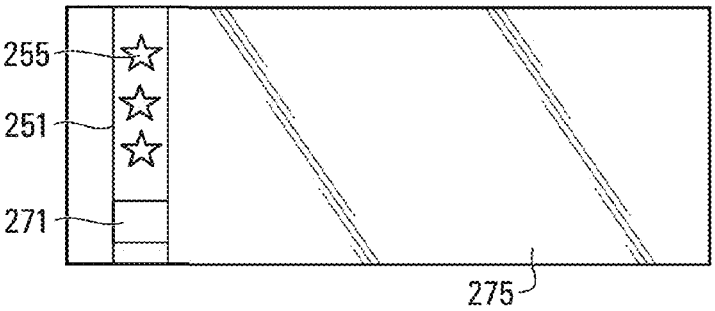
FIG. 5E shows a plan view of the optical security device/foil combination of FIG. 5D mounted to the substrate.

The foil 251 is then transferred to a substrate 275 such as a bank note or other substrate. As shown in FIG. 5D, the substrate 275 may include a window area 277 and the foil applied so that the foil window 253 registers with the substrate window 277. The window allows light to pass through the foil and substrate to enable authentication of the security device using its angle-dependent colour shift for transmissive light, as described above. A plan view of an example of the foil applied to a rectangular substrate is shown in FIG. 5E. The window 277 may comprise a transparent material or a void. It should be understood that if the window is implemented as a void, a suitable laminate will be used in place of a foil.

In another embodiment, the security device may be applied directly to a substrate, i.e. without an intermediate foil, and various examples are described below with reference to FIGS. 6A to 6E.

Figure 6A:
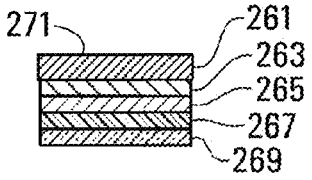
FIG. 6A shows a cross-sectional view through an optical security device according to another embodiment of the present invention.

Referring to FIG. 6A, a patch 271 is provided having a web carrier layer 261, a release layer 263, an optical thin film layer 265, a luminescent layer 267 and an adhesive layer 269. The patch may be formed in a similar manner to that described above in connection with FIGS. 5A to 5E.

Figure 6B:
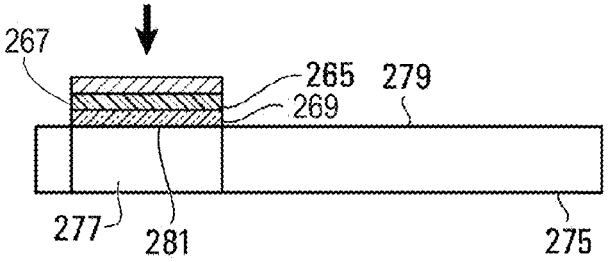
FIG. 6B shows a cross-sectional view of the optical security device of FIG. 6A when mounted to a substrate.

Referring to FIG. 6B, a substrate 275 is provided having a window area 277. The patch 271 is positioned over the window area 277 and transferred and adhered to the upper surface 279 of the substrate by means of the adhesive layer 269. The window area 277 may include a transparent material, in which case, the adhesive layer may directly adjoin the upper surface 281 of the transparent material. Alternatively, the window area may comprise a void and the adhesive layer secured to a perimeter region or margin of the bank note (or other substrate) surrounding the window.

Figure 6C:
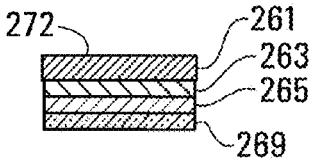
FIG. 6C shows a cross-sectional view of an optical security device according to another embodiment of the present invention.
Figure 6D:
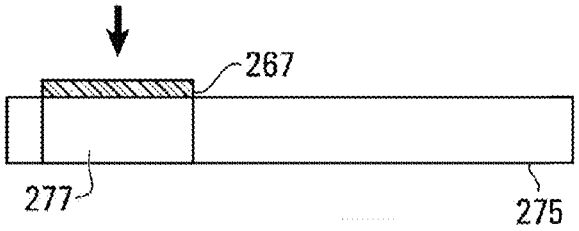
FIG. 6D shows a cross-sectional view of a substrate for receiving the optical security device of FIG. 6C.
Figure 6E:
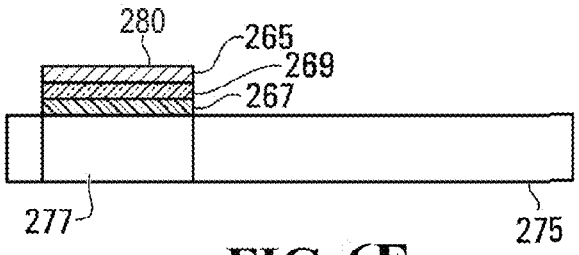
FIG. 6E shows a cross-sectional view of the optical security device of FIG. 6C mounted to the substrate of FIG. 6D.

In another embodiment, the luminescent layer and the optical thin film structure are each applied to the substrate in separate steps. An example of such a process is shown in FIGS. 6C to 6E. Referring to FIG. 6C, a carrier web or foil 261 is provided having a release layer 263. Layers forming an optical thin film 265 are deposited onto the release layer 263 using any suitable deposition or coating technique, for example, PVD, CVD, PECVD, sputtering or any other suitable process. An adhesive layer 269 is subsequently applied to the optical thin film 265. A discrete area is removed from the resulting multi-layer structure to provide a patch 272.

Referring to FIG. 6D, a substrate 275 is provided having a window area 277 which may comprise a transparent material. A luminescent layer 267 is applied to the substrate over the window region. The luminescent layer may comprise an ink containing a luminescent substance, for example luminescent pigments, and may be printed over the transparent window using any suitable printing technique, for example offset printing, intaglio printing or another printing technique.

The patch 272 is subsequently applied to the luminescent layer and is secured thereto by means of the adhesive layer 269. The carrier foil 261 and the release coat 263 are removed to provide a substrate with a security device 280 mounted thereon comprising the luminescent layer 267, an adhesive layer 269 above the luminescent layer, and an optical thin film 265 above the adhesive layer (see FIG. 6E).

In an alternative embodiment, the luminescent material may be incorporated into the adhesive layer. The combined layer may be produced by mixing the luminescent substance or pigments into the adhesive mixture. In some embodiments, this would eliminate the need for a separate luminescent layer, although other embodiments may include both an adhesive layer containing luminescent material, and a separate layer also containing luminescent material. In this latter embodiment, the adhesive layer may contain luminescent material of one type (e.g. producing one colour or a group of colours, and the separate luminescent layer may contain luminescent material of another type, for example producing another colour or another group of colours).

In another embodiment luminescent material of two different wavelengths is placed on opposite sides of thin film color-shifting patch in a windowed region of banknote substrate forming different indicia. The images formed by observing the luminescent emission varies depending not only on the angle of view but differs on which side of the note one is viewing. The ability to display different luminescent images on different sides of transparent window which change appearance with different angle is anticipated to provide additional security.

Figure 7A:
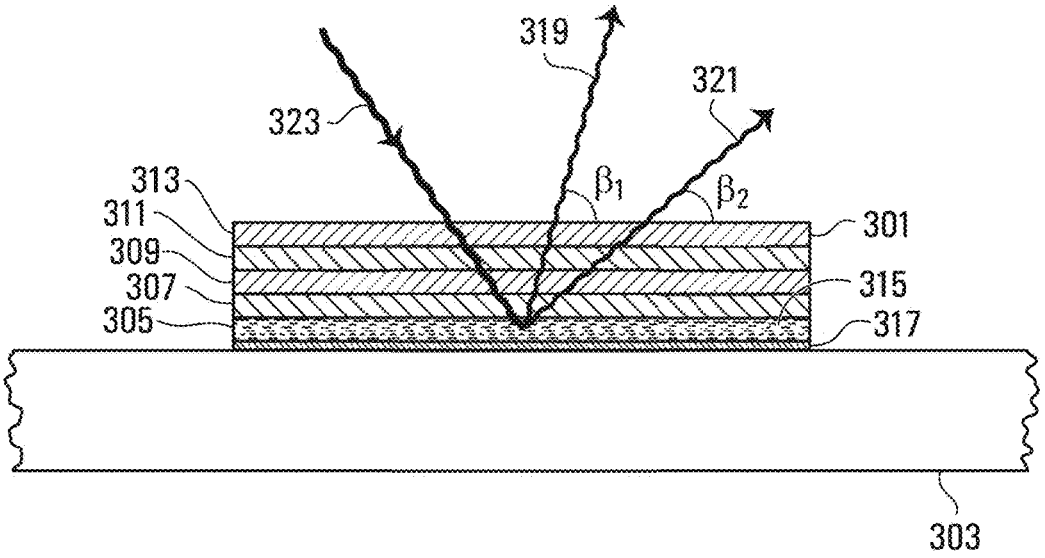
FIG. 7A shows a cross-sectional view of an optical security device according to another embodiment of the present invention.

In other embodiments, rather than the luminescent material being disposed externally of the optically variable device, the luminescent substance may be included within the optically variable device. Where the optically variable device comprises a multi-layer interference structure, the luminescent substance may be included in one or more layers of the optical interference structure or within the optical interference structure as a separate layer. FIG. 7A shows an example of an optical security device 301 mounted on a substrate 303 in which the optically variable device comprises an optical interference stack comprising a plurality of layers 305, 307, 309, 311, 313. A luminescent substance 315 is included in one of the layers, which, in this example, is the lowest most layer 305. The luminescent substance may be deposited as part of the material forming a particular layer using any suitable deposition technique such as PVD, CVD, PECVD, sputtering or any other suitable process. The luminescent substance may be selected so that it can withstand the temperatures involved in the deposition process, an inorganic substance, for example. An optional reflective layer 317 may be provided below the layer 305 containing the luminescent substance to reflect the luminescence stimulating radiation back into the luminescent substance to increase the intensity of the luminescent signals. The luminescent substance may be capable of emitting luminescence at one or more wavelengths, which may be in the visible spectrum, thereby emitting one or more different visible colours. For example, the luminescent substance may contain luminescent pigments which luminesce at a single wavelength or colour or a mixture of luminescent pigments which luminesce at different wavelengths. The refractive index and the thickness of each layer of the interference structure are selected so that each luminescent colour emitted from the luminescent substance is emitted from the optically variable device at a particular, discrete angle or range of angles to produce an angle-dependent colour shift effect. In the particular embodiment of FIG. 7A, the luminescent substance contains a mixture of two different colour pigments and the optically variable structure is tuned to the luminescent wavelengths so that light having a first colour 319 is emitted at a first angle $\beta 1$ and light of a second colour 321 is emitted at a second angle $\beta 2$ when the device is illuminated by a UV or other stimulating light source 323.

Figure 7B:
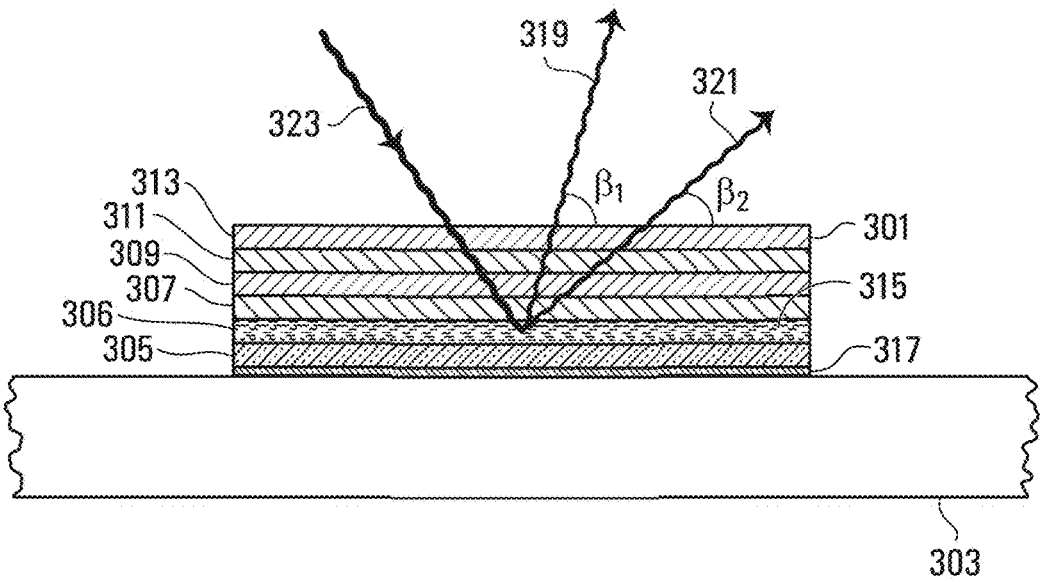
FIG. 7B shows a cross-sectional view of an optical security device according to another embodiment of the present invention.

FIG. 7B shows a cross-sectional view of a security device according to another embodiment of the present invention. The security device is similar to that shown in FIG. 7A and like parts are designated by the same reference numerals. The main difference between the embodiment of FIG. 7B and that shown in FIG. 7A is that in FIG. 7B, the luminescent substance is incorporated into the optically variable device as a separate layer 306, rather than into one of the optically variable layers. This configuration enables the luminescent layer to be deposited in a separate process from the processes involved in depositing the dielectric layers. This might enable the luminescent layer deposition process to be specifically tailored to the particular type of material, possibly with the use of lower temperatures resulting in a wider variety of luminescent materials that can be used. For example, the use of lower temperatures might allow more suitable chromophores to be used in the luminescent material, including chromophores with higher efficiency for ease of detection or viewing. Lower efficiency chromophores may also be used, and might be more suitable for machine detection. The security device shown in FIG. 7B may function in a similar manner to that of FIG. 7A.

In some embodiments of the optical security device, one or both of the optically variable structure and the luminescent material may be formed as a plurality of discrete elements, for example particles or flakes rather than as single continuous components.

Another embodiment of the invention may use flakes or particles in the optically variable portion of the device.

Figure 8:
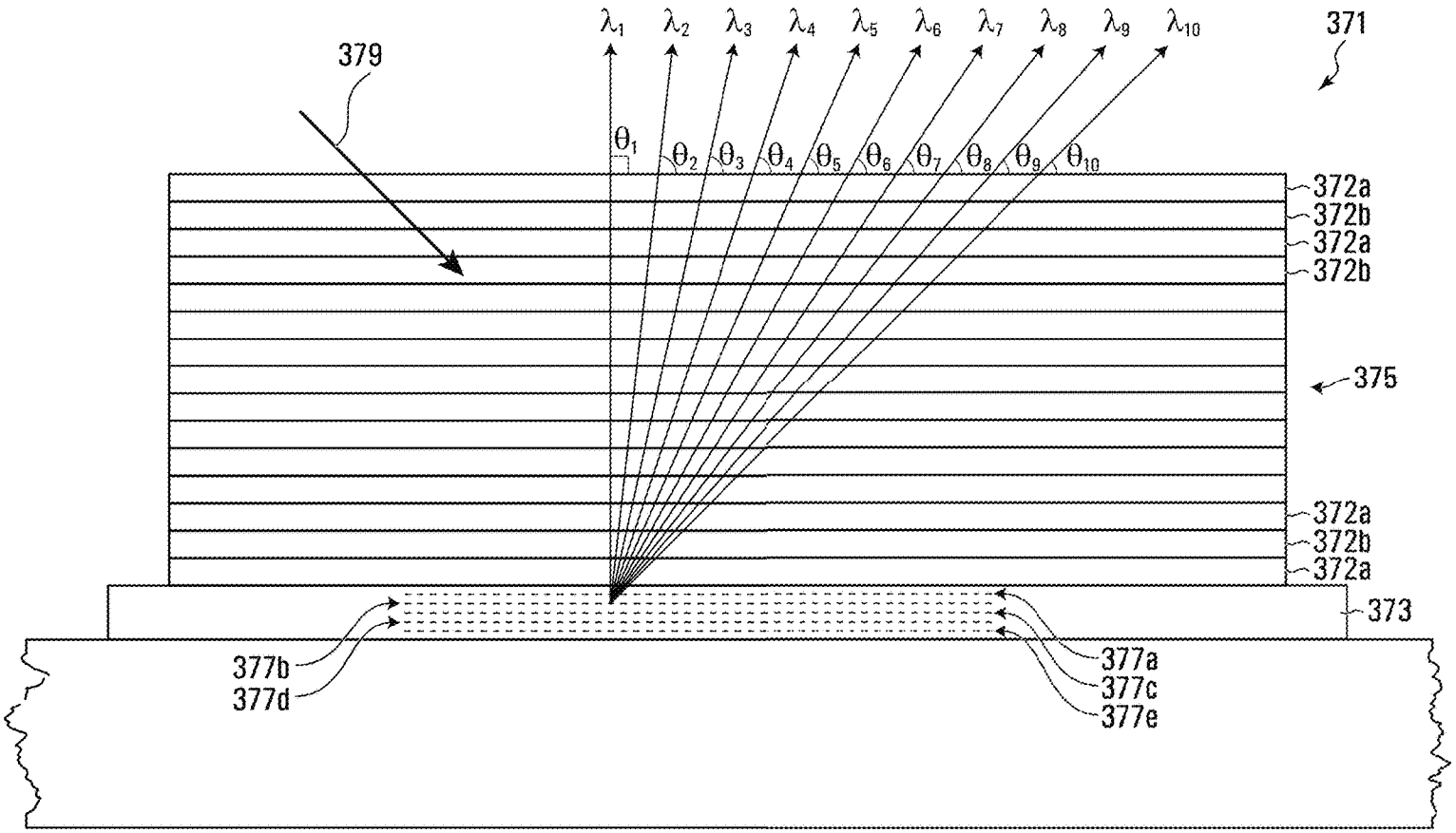
FIG. 8 shows a cross-sectional view of an optical security device according to another embodiment of the present invention.

Referring to FIG. 8, illustrated is an example of an optical security device capable of producing color shift effects. In FIG. 8, the optical security device 371 comprises a luminescent material 373 and an optically variable device 375 comprising a multi-layer film or structure. The material for each layer is selected so that the refractive indices alternate from one layer to the next between different values. The number of layers is entirely arbitrary and may be selected depending on the optical characteristic required. The multi-layer structure may for example comprise any number of layers ranging from 20 to 300 or more. The multi-layer structure may be formed by co-extrusion in which the resulting layer thicknesses are controlled by parameters of the extrusion process, for example the extrusion rate. Any suitable materials may be used to form the layers, and in one non-limiting example, the layers may comprise plastic or polymeric material, for example alternating layers of polystyrene and polymethylmethacrylate, which have refractive indices of 1.59 and 1.49, at 550 nm respectively. As noted above, the structure may be used to filter the various wavelengths produced by the luminescent material to produce a complete or incomplete image of the predetermined indicia.

In the embodiment illustrated in FIG. 8, the luminescent material 373 provides a source of luminescence of different colours or wavelengths, for example $\lambda_1$ to $\lambda_{10}$. The optically variable device 375 has a relatively high transmittance for each of a number of different wavelengths at a respective different angle, for example $\theta_1$ to $\theta_{10}$, so that a change in colour is observed with a change of emission angle. For example, the optically variable device may be adapted to transmit a dominant wavelength or dominant band of wavelengths at a particular angle while suppressing, at that angle, other luminescent wavelengths generated by the luminescent material or source 373. As the emission angle varies, the transmitted luminescent wavelength or colour may change continuously so that each transmitted colour is different from any other transmitted colour. Alternatively, the same colour may be repeated one or more times for different emission angles.

In some embodiments, one or more luminescent colours may be associated with a particular symbol or image. For example, the luminescent material 373 may comprise a plurality of layers 377*a* to 377*e*, each layer comprising a luminescent material which luminesces at a particular wavelength or colour. Each layer may be adapted to luminesce at a different wavelength or colour. A plurality of different layers may define a particular image or symbol and two or more symbols may be different or the same. When the luminescent source 373 is stimulated by appropriate stimulating radiation 379, the image associated with each colour will appear at a particular observation angle and the observed colour and possibly the symbol being viewed will change as the observation or emission angle changes. In one non-limiting example, differently coloured layers 377*a* to 377*e* define a respective number, for example 5, 4, 3, 2, 1 (or any other sequence or group of numbers). As the observation angle relative to the security device changes, the numbers will appear one after the other depending on the colour and order of colours that are transmitted by the optically variable device as the observation angle is progressively changed. Thus, the order in which the different symbols appear is essentially controlled by the optically variable device. The symbol(s) and its associated colour and the order in which the symbols appear with a change in emission/observation angle provide other security features which can be encoded into the security device and used for authentication.

As an alternative to the above, instead of having various sequences or numbers appear, a specific portion of an image can be made to appear in sequence as the viewing angle changes. In one embodiment, a predetermined indicia could take the form of an image of a maple leaf. At one viewing angle, the top portion of the leaf is visible, at another viewing angle the middle portion of the leaf is visible, while at a third viewing angle the bottom portion of the leaf is visible. At a fourth viewing angle, the complete image of the leaf is visible. This can be done by judiciously layering and locating specific configurations of luminescent material.

It will be appreciated that forming one or more luminescent emitters or materials as a symbol to provide an additional security feature may be implemented in any of the embodiments described herein, for example, the embodiments of FIGS. 2A and 2B, in which the optical interference structure has fewer layers.

Figure 9A:
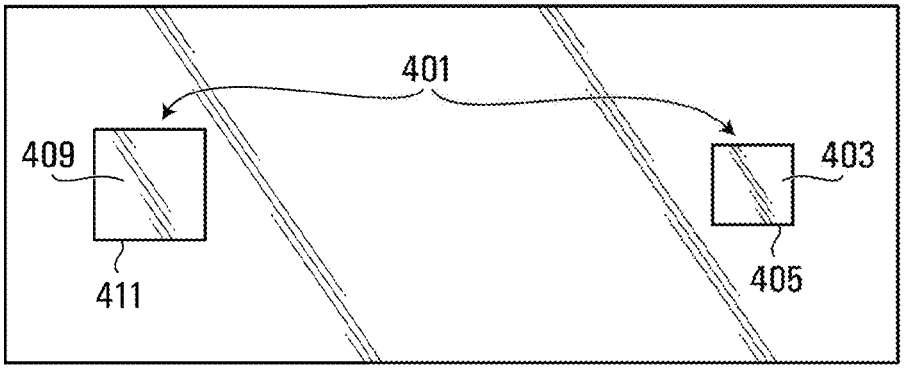
FIG. 9A shows a plan view of a distributed optical security device or feature disposed on a substrate, according to an embodiment of the present invention.
Figure 9B:
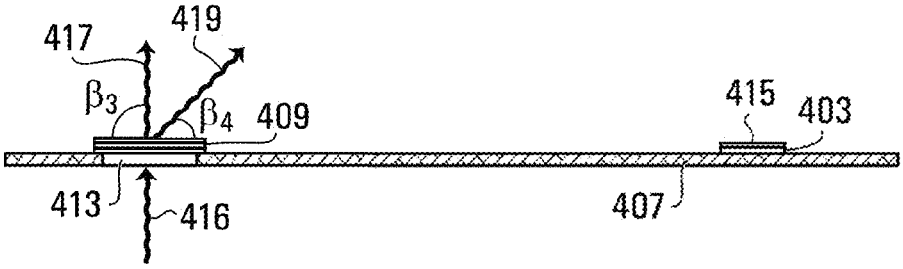
FIG. 9B shows a cross-sectional view of the optical security device shown in FIG. 9A.

In other embodiments, the optically variable device and the luminescent layer of the security device may be disposed at different locations on a substrate, and authentication of the security device may be performed by folding the substrate so that the optically variable device overlays the luminescent layer. An example of such a "distributed" security device is shown in FIGS. 9A to 9B. In one implementation of this embodiment, an incomplete image of the predetermined indicia may be visible to a viewer at all times. Only when the substrate is folded to cause the optically variable device to overlay the luminescent layer is the viewer presented with a complete image of the predetermined indicia. Referring to FIGS. 9A and 9B, a security device 401 comprises a luminescent material 403 positioned at a first location 405 on a flexible, sheet-like substrate 407 and an optically variable device 409 secured to the substrate at a second location 411. The optically variable device is positioned over a window region 413 formed in the substrate 407 to allow light to pass from one side of the substrate to the other through the optically variable device. The luminescent layer may include an optional protective cover layer 415, formed, for example, of a polymeric material, to protect the luminescent layer 403 from damage by scratching or scuffing, for instance.

In this embodiment, the optically variable device exhibits an angular dependent colour shift for transmissive light and may comprise a multi-layered optical interference structure similar to that described above. The luminescent material may be one which luminesces at one colour only or one which luminesces at two or more colours. The optically variable device is tuned to the luminescent colour or colours so that each particular colour is transmitted through the optically variable device and emitted therefrom at a discrete angle or a discrete range of angles to produce luminescence with an angle-dependent colour shift effect.

In another variant of the invention, the optically variable structure may be constructed from a liquid crystal material. In this variant, the liquid crystal material produces an angle-dependent colour shift in emitted luminescence from the security device. One or more layers of liquid crystal material may be disposed above a luminescent material capable of luminescing at one or more wavelengths, and the layer(s) of liquid crystal material may be tuned to selectively transmit a particular wavelength of light therethrough at a particular angle. As with the embodiments and alternatives discussed above, the liquid crystal variants of the invention may be used to produce an incomplete image of the predetermined indicia at specific viewing angles. Upon changing the viewing angle, these liquid crystal variants can then produce the complete image of the predetermined indicia.

In such a variant using a liquid crystal material, the luminescent layer is capable of luminescing at two different wavelengths in the visible spectrum, although in other embodiments, the luminescent layer may be capable of emitting only one wavelength in the visible spectrum or more than two wavelengths in the visible spectrum. This embodiment may be configured such that when the luminescent layer luminesces at one wavelength, only an incomplete image of the predetermined indicia is viewable. When the luminescent layer luminesces at another wavelength, a complete image of the predetermined indicia is viewable.

In other embodiments, luminescent material may be included within an adhesive layer to take the place of the luminescent layer. In further embodiments, luminescent material may be included in the adhesive layer in addition to a separate luminescent layer.

To utilize the above noted variant, the security device may be configured to always produce a complete image of the predetermined indicia (e.g. a complete image of a maple leaf). At select angles or ranges of angles, a portion of the image is suppressed or is not visible to the user (e.g. a lower half of the image of the maple leaf).

In other embodiments, the security device may be adapted to replace the "absence" of colour at the particular viewing angle (or range of angles) with a different colour. This may be implemented by adapting the luminescent material to generate a second colour and by adapting the optically variable structure to transmit the colour with a relatively high intensity only at the particular angle or in a range of angles where the other colour is significantly diminished or substantially absent. Alternatively, emission of the second colour may be controlled with little or no angular dependence, so that both colours are emitted together over a relatively wide range, with the observed colour being the additive effect of the combination, for example, except for a window within the angular range, at which the second colour dominates.

In other embodiments, the liquid-crystal based optical security device may be adapted to emit a first colour or wavelength which has angle-dependence and a second colour or wavelength which has less, little or no angle dependence. In this case, the second colour will be observed over a relatively wide angular range, and the combination of both the first and second colours will be observed only or predominantly for a specific angle or limited range of angles. The second color can thus be used to produce the incomplete image of the predetermined indicia while the combination of the first and second colors can be used to produce the complete image of the predetermined indicia.

It is to be noted that the variants described above are not limited to liquid-crystal based features, but may also be implemented by other optically variable devices or structures, e.g. optical interference structures, such as those having a number of layers of material in which adjacent layers have different refractive indices.

In yet another variant, the security device according to another aspect of the invention may be fabricated on a foil carrier and subsequently transferred to a substrate.

Figure 10:
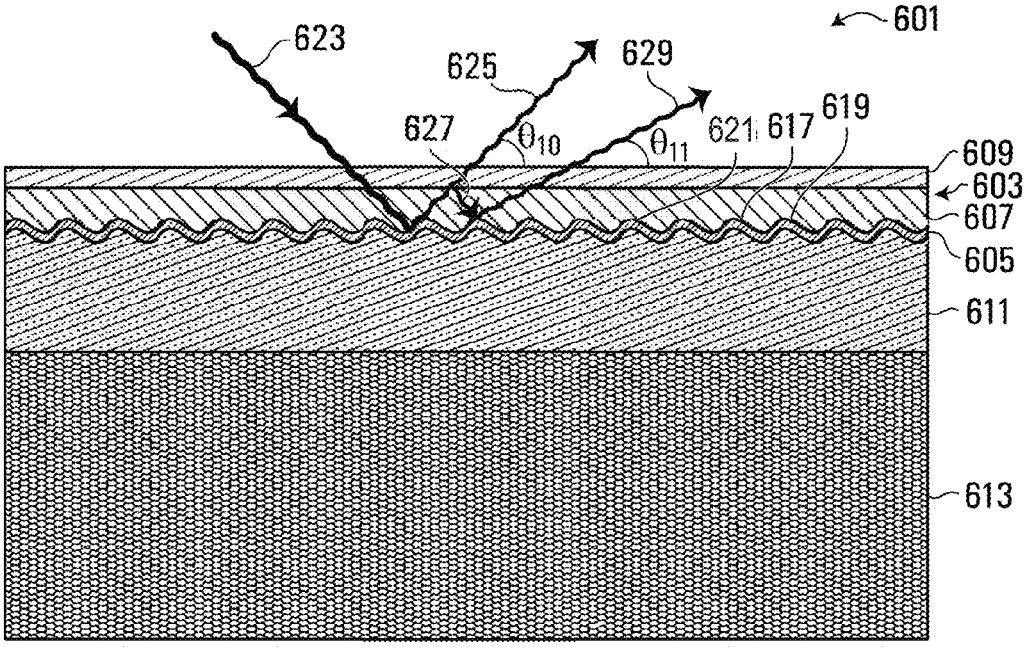
FIG. 10 shows a cross-sectional view of an optical security device based on a holographic structure according to an embodiment of the present invention.

In another embodiment of the optical security device, the optically variable device or structure may comprise a holographic structure to provide an angle-dependent colour or wavelength shift of luminescent emission. The security device can be configured such that, at a first range of angles, only an incomplete image of the predetermined indicia is viewable. At another range of angles, a complete image of the predetermined indicia is viewable. An example of such a security device that uses a hologram is shown in FIG. 10. The optical security device 601 comprises a holographic optically variable device 603 which includes a reflective layer 605, a luminescent layer 607, and an upper layer 609 above the luminescent layer 607. The optical security device also includes an optional protection layer 611 below the reflective layer 605, and may include an optional adhesive layer 613.

The reflective layer 605 defines a hologram or holographic pattern by surface perturbations formed at the interface 617 between the reflective layer 605 and luminescent layer 607. In some embodiments, the hologram may be formed as an embossed structure on the lower surface 619 of the luminescent layer 607 by stamping, molding or another suitable process. The reflective layer may be subsequently formed on the embossed surface 619 by any suitable technique, which may include vacuum deposition, sputtering or any other suitable coating or deposition process. In other embodiments, the holographic pattern may be formed on the upper surface 621 of the protection layer 611, and the reflective layer subsequently formed thereon.

The luminescent layer 607 contains luminescent material which is capable of emitting luminescent radiation at one or more colours or wavelengths when stimulated by excitation radiation 623 such as UV light. In the present embodiment, the upper layer 609 is at least partially transparent to excitation radiation 623, and is at least partially transparent to luminescent radiation emitted from the luminescent layer. The optically variable device is adapted to reflect part of the luminescent radiation directed towards the upper layer 609 back towards and into the luminescent layer. This may be achieved by forming the upper layer 609 of material with a different refractive index to that of the luminescent layer 607, so that part of the luminescence is reflected at the interface of the two layers 609, 607. Alternatively, or in addition, the upper layer 609 may comprise a partially reflective material, for example, a semi-mirrored material, to reflect part of the luminescence back towards the luminescent layer.

When the luminescent layer 607 is stimulated, part of the luminescent light 625 is diffracted by the diffraction structure and partially reflected by the upper layer 609, resulting in a change in phase of the reflected light. Luminescent light within the space between the diffraction structure and upper layer undergoes constructive and destructive interference. The constructive interference results in a relatively strong luminescent signal at a particular emission angle or range of emission angles which is transmitted through the upper layer 609. Thus, the space between the diffraction structure and the upper layer acts as a cavity which supports constructive interference for a given wavelength at a particular angle. The device thereby emits luminescence whose intensity varies with emission angle to produce an angle dependent luminescent characteristic. In the present embodiment, the luminescent material generates luminescence of a plurality of different colours or wavelengths, and emits luminescent radiation 625 of a first colour or wavelength with a peak intensity at a first angle $\theta_{10}$, and emits luminescent radiation 629 of a second colour or wavelength with a peak intensity at a second angle $\theta_{11}$. Thus, in this embodiment, the holographic structure provides a fluorescent hologram with an angle-dependent colour-shift.

The protection layer 611 may be formed of any suitable material such as an epoxy resin which cannot easily be removed from the reflective layer 605, thereby preventing access to the holographic pattern and possible copying of the holographic pattern. The optional adhesive layer 613 enables the security device to be mounted and fastened to a substrate.

In some embodiments, an optical interference structure may be placed above the luminescent layer, for example, adjacent the luminescent layer if the upper layer 609 is omitted, or adjacent the upper layer, if retained. The optical interference structure may comprise a plurality of layers of material, adjacent layers having different refractive indices. The provision of an optical interference structure may enhance the luminescent emissivity of the security device, and/or the angle-dependent effect.

In other embodiments, the reflective layer 605 may be omitted. In this case, reflection from the diffraction structure may be achieved by forming the layer adjacent the luminescent layer of a material having a refractive index different to that of the luminescent layer 607. The security device can be configured such that, at one range of viewing angles, a holographic image of an incomplete predetermined indicia is viewable. At another range of viewing angles, a holographic image of a complete predetermined indicia is viewable.

Yet another variant of the present invention uses an interferometric mechanical modulator system whose optical reflection and absorption characteristics can be modified by varying the spacing between an absorber and a reflector separated by an air gap. The reflection and absorption characteristics can be used to good effect by varying the image viewable by the user as the characteristics are varied.

Yet another variant of the present invention uses an optically variable device made from a laterally extending array of generally planar, spaced apart light-blocking members disposed in a layer of transparent material. The light-blocking elements may be oriented by any suitable means, including magnetic means or non-magnetic means, such as electrostatic or electrophoretic means (using an electric field) or by ultrasonic means (using an acoustic field). For magnetic orientation, the light-blocking elements contain a magnetic or magnetizable material. Once a layer of the optically variable device has been applied to the luminescent layer, with the fluid composition making up the optically variable device still in the fluid state, a magnetic field may be applied to the security device by means of a suitable source of magnetic flux such as one or more permanent magnets and/or one or more electromagnets. The light-blocking elements in the fluid composition orient themselves along the applied magnetic field lines so that their planes adopt the required orientation. The composition is subsequently hardened to fix the light-blocking elements in position.

This variant of the optical security device operates as follows to produce luminescence. When excitation light is directed towards the optical security device at an angle to its surface such that the luminescent layer of the light-blocking elements are exposed thereto, the luminescent layer will emit luminescent radiation having a first colour or wavelength over a first range of angles. At viewing angles substantially parallel to the substrate surface, luminescence will only be emitted from the left-most light-blocking element.

The security device of any aspect or embodiment of the invention may be applied to or incorporated in any item or object to provide a means of authentication, non-limiting examples of which include currency e.g. bank notes, other financial transaction instruments, such as credit and debit cards, any documents or any goods.

Other aspects and embodiments of the present invention may comprise any feature disclosed herein in combination with any one or more other features disclosed herein.

In any aspects or embodiments of the invention, any one or more features may be omitted altogether or replaced by another feature which may or may not be an equivalent or variant thereof.

Numerous modifications to the embodiments described above will be apparent to those skilled in the art.

A person understanding this invention may now conceive of alternative structures and embodiments or variations of the above all of which are intended to fall within the scope of the invention as defined in the claims that follow.

We claim:

1. A security device comprising:

luminescent materials in distinct, non-overlapping regions of the device from one another, that are the same or different from one another, with no overlap between any luminescent materials, that when stimulated emit luminescent radiations from the distinct, non-overlapping regions of the security device;

an angle-dependent optical filter coupled to one of the luminescent materials so that luminescent radiation emitted therefrom is transmitted through and emitted from the filter only at certain angles, to selectively coincide with luminescent radiation emitted from another of the luminescent materials, thereby to form a composite image comprising the luminescent radiations emitted from the luminescent materials in said distinct, non-overlapping regions of the device only when the device is viewed at said certain angles.

2. The security device of claim 1, wherein the luminescent materials, when stimulated, emit luminescent radiations having different wavelengths from one another.

3. The security device of claim 1, wherein the angle-dependent optical filter, after filtering the luminescent radiation of the coupled luminescent material, emits luminescent radiation of the same wavelength as unfiltered luminescent radiation emitted from the other luminescent material(s).

4. The security device of claim 1, wherein the composite image forms one or more letter, number, icon or picture.

5. The security device of claim 1, wherein at least two of the luminescent materials are separated from one other by the angle-dependent optical filter, which overlies the luminescent material to which it is coupled, so that luminescent radiation emanating from the coupled luminescent material passes through the angle-dependent optical filter, whereas the luminescent radiation emanating from at least one of the other luminescent materials does not pass through the angle-dependent optical filter.

6. The security device of claim 1, wherein the angle-dependent optical filter comprises a chromatic filter, an optical interference structure, or a Fabry-Perot optical cavity.

7. The security device of claim 1, wherein the angle-dependent optical filter selectively modifies the emission of the luminescent radiation from one of the luminescent materials, but not the others.

8. The security device of claim 1, further comprising one or more further luminescent materials each, when stimulated, emitting further luminescent radiations from the device, so that the luminescent radiations selectively coincide with one another to form one or more composite images when the device is viewed at different angles.

9. A security document comprising:

a. a substrate; and b. one or more security devices of claim 1 attached thereto, or integrated therein.

10. The security document of claim 1, wherein the substrate comprises a polymer.

* * * * *